US008761624B2

(12) United States Patent
Kiryu

(10) Patent No.: US 8,761,624 B2
(45) Date of Patent: Jun. 24, 2014

(54) IMAGE FORMING DEVICE, IMAGE FORMING METHOD, AND IMAGE FORMING SYSTEM FOR CONTROLLING A POSITION OF AN INTERMEDIATE TRANSFER BODY IN A WIDTH DIRECTION

(75) Inventor: Koji Kiryu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 275 days.

(21) Appl. No.: 13/421,303

(22) Filed: Mar. 15, 2012

(65) Prior Publication Data

US 2012/0237240 A1 Sep. 20, 2012

(30) Foreign Application Priority Data

Mar. 18, 2011 (JP) ..... 2011-061726
Feb. 7, 2012 (JP) ..... 2012-024490
Mar. 14, 2012 (JP) ..... 2012-057228

(51) Int. Cl.
*G03G 15/01* (2006.01)
*G03G 15/16* (2006.01)

(52) U.S. Cl.
CPC ..... *G03G 15/1605* (2013.01)
USPC ..... 399/66; 399/121; 399/301; 399/302

(58) Field of Classification Search
CPC ..... G03G 15/1605; G03G 15/1615; G03G 2215/0016; G03G 2215/00156; G03G 2215/0158
USPC ..... 399/49, 66, 72, 121, 301, 302
See application file for complete search history.

(56) References Cited

U.S. PATENT DOCUMENTS 6,061,542 A 5/2000 Minami et al.
7,437,100 B2 10/2008 Kiryu
7,759,887 B2 7/2010 Kiryu
7,853,189 B2 * 12/2010 Kamoshita et al. ..... 399/302
8,000,622 B2 8/2011 Ishizaki et al.
8,023,872 B2 * 9/2011 Tao et al. ..... 399/302
2010/0008689 A1 1/2010 Iwasaki et al.
2011/0229159 A1 9/2011 Kiryu

FOREIGN PATENT DOCUMENTS

JP 11102098 A 4/1999
JP 11327405 A 11/1999
JP 2002-287527 A 10/2002
JP 3799763 B2 5/2006
JP 4244594 A 1/2009

OTHER PUBLICATIONS

English language abstract for JP 2004-078082 corresponds to JP 4244594.
English langauge abstract for US-6,061,542 corresponds to JP 3799763.

* cited by examiner

*Primary Examiner* — William J Royer
(74) *Attorney, Agent, or Firm* — Harness, Dickey & Pierce, P.L.C.

(57) ABSTRACT

Disclosed is an image forming device that forms toner images on corresponding photosensitive bodies, and performs primary transfers for transferring the toner images on the corresponding photosensitive bodies onto an intermediate transfer body and performs a secondary transfer for transferring the toner images from the intermediate transfer body onto a recording medium. The image forming device includes a position detection unit that detects a position of the intermediate transfer body; a position control unit that controls movement of the intermediate transfer body; a speed determination unit that determines a speed of the intermediate transfer body; and an image forming control unit. The image forming control unit causes the image forming device to form the toner images, to perform primary transfers or to perform a secondary transfer, when the intermediate transfer body is moving at a constant speed.

13 Claims, 22 Drawing Sheets

FIG.6

| | WAITING STATE | MONOCHROME MODE STATE | COLOR MODE STATE |
|---|---|---|---|
| INTERMEDIATE TRANSFER BELT TARGET POSITION | P1 | P2 | P3 |

IMAGE FORMING DEVICE, IMAGE FORMING METHOD, AND IMAGE FORMING SYSTEM FOR CONTROLLING A POSITION OF AN INTERMEDIATE TRANSFER BODY IN A WIDTH DIRECTION

BACKGROUND OF THE INVENTION

1. Field of the Invention

Embodiments of the present invention relate to an image forming device that can control a position of an intermediate transfer body in a width direction. Specifically, the embodiments relate to the image forming device that can reduce downtime by controlling the position of the intermediate transfer body in the width direction.

2. Description of the Related Art

In an image forming device having an intermediate transfer belt, a toner image is transferred from a photosensitive drum onto the intermediate transfer belt by rotating the photosensitive drum while circulating the endless intermediate transfer belt. In a color image forming device, the above process is repeated four times, and a color toner image is formed on the intermediate transfer belt by superimposing four toner images on the intermediate transfer belt. Therefore, it is important that positions of the four toner images in the circulating direction and in the width direction of the intermediate transfer belt accurately coincide with each other.

A technique for causing the positions of the four toner images to coincide has conventionally been known (c.f. Patent Document 1 (Japanese Published Unexamined Application No. H11-102098)). Patent Document 1 discloses an image forming device that optically detects plural marks for detecting positional shifts formed on the intermediate transfer belt, and that corrects the positional shifts based on the spacing among the plural marks for detecting the positional shifts.

Further, the intermediate transfer belt rotates while suspended by plural rollers. Thus, when a primary transfer roller or a secondary transfer roller contacts the intermediate transfer belt, a force acts on the intermediate transfer belt along an axis direction of a transfer roller by the impact of the contact. When the force acts on the intermediate transfer belt, the intermediate transfer belt may start moving in the axis direction of the transfer roller so as to find a stable rotational position (hereinafter, this movement is referred to as a width direction movement), due to an error on placing the transfer roller or tension of the intermediate transfer belt. When the width direction movement occurs, the whole intermediate transfer belt slowly moves in the main scanning direction.

It is preferable that a position of the intermediate transfer belt in the width direction be set to be at a target position. As a method of correcting the position of the intermediate transfer belt in the width direction, the steering method has conventionally been known. In the steering method, the position of the intermediate belt in the width direction is controlled by varying tilts of the rollers that suspend the intermediate transfer belt (hereinafter, referred to as the steering rollers).

An image forming device that can control the position by the steering method has an edge sensor that detects an end portion of the belt in the width direction (hereinafter, referred to as the edge position). The image forming device compares the edge position and the target position, and controls the tilts of the steering rollers depending on the result of the comparison.

When the steering method is adopted, since the intermediate transfer belt is caused to be moved to a stable target position, a moving amount in the width direction with respect to the target position eventually becomes zero. However, it has been known that, when an image is formed while the intermediate transfer belt is moving in the width direction, the quality of the image is significantly degraded. Therefore, when the primary transfer roller or the secondary transfer roller contacts the intermediate transfer belt, the image forming operation is temporarily stopped. The image forming operation is restarted, after waiting for the position of the intermediate transfer belt in the width direction to be stabilized.

Here, it takes a few seconds to a few minutes for the image forming device to correct the moving amount in the width direction by using the steering method. The time interval for controlling the position of the intermediate transfer belt in the width direction is downtime for the image forming device.

When the downtime is lengthened, the printing efficiency of the image forming device is lowered. To overcome this problem, a method has been developed to reduce the downtime by changing the target position of the intermediate transfer belt in the width direction, so as to quickly stabilize the position of the intermediate transfer belt in the width direction (c.f. Patent Document 2 (Japanese Registered Patent No. 4244594)).

SUMMARY OF THE INVENTION

In one aspect, there is provided an image forming device configured to form toner images on corresponding photosensitive bodies, and configured to perform primary transfers for transferring the toner images on the corresponding photosensitive bodies onto an intermediate transfer body and to perform a secondary transfer for transferring the toner images from the intermediate transfer body onto a recording medium.

The image forming device includes a position correction unit that causes plural toner image forming units to form predetermined patterns and that corrects forming positions of the toner images by the corresponding toner image forming units in a direction parallel to a rotation axis of the intermediate transfer body, based on information about spacing among the patterns, the spacing among the patterns being read by a pattern reading unit; a position detection unit that detects a position of the intermediate transfer body in the direction parallel to the rotation axis; a position control unit that controls movement of the intermediate transfer body; a speed determination unit that determines whether a speed in the direction parallel to the rotation axis of the intermediate transfer body is stabilized, based on a time variation of the position of the intermediate transfer body detected by the position detection unit; and an image forming control unit that causes the position correction unit to correct the forming positions of the toner images, causes the plural toner image forming units to form the corresponding toner images, causes the image forming device to perform the corresponding primary transfers, and causes the image forming device to perform the secondary transfer.

When the position control unit controls the movement of the intermediate transfer body so that the intermediate transfer body is moved in the direction parallel to the rotation axis to a target position, the position control unit causes the intermediate transfer body to move to the target position at a constant speed at least during a part of a first time interval. Here, the movement of the intermediate transfer body is controlled by the position control unit during the first time interval.

When the speed determination unit determines that the speed in the direction parallel to the rotation axis of the intermediate transfer body is stabilized, the image forming control unit causes the position correction unit to correct the forming positions of the toner images, and subsequently, the image forming control unit causes the plural toner image forming units to form the corresponding toner images, causes the image forming device to perform the corresponding primary transfers, or the image forming device to perform the secondary transfer, during a time interval in which the intermediate transfer body is moving in the direction parallel to the rotation axis of the intermediate transfer body at the constant speed.

In another aspect, there is provided a non-transitory computer readable recording medium storing an image forming program that causes an image forming device including plural toner image forming units configured to form toner images on corresponding photosensitive bodies; plural primary transfer units configured to cause the corresponding photosensitive bodies to contact an intermediate transfer body and configured to transfer the corresponding toner images onto the intermediate transfer body; a secondary transfer unit configured to cause a recording medium to contact the intermediate transfer body and configured to transfer the toner images on the intermediate transfer body onto the recording medium; and a position correction unit configured to cause the plural of the toner image forming units to form predetermined patterns and configured to correct forming positions of the toner images by the corresponding toner image forming units in a direction parallel to a rotation axis of the intermediate transfer body, based on information about spacing among the patterns, the spacing among the patterns being read by a pattern reading unit, to perform: a position control step of controlling movement of the intermediate transfer body such that, when the position of the intermediate transfer body in the direction parallel to the rotation axis of the intermediate transfer body detected by a position detection unit is moved to a target position, the position control step causes the intermediate transfer body to move to the target position at a constant speed at least during a part of a first time interval, the movement of the intermediate transfer body being controlled by the position control step during the first time interval; a speed determination step of determining whether a speed of the intermediate transfer body in the direction parallel to the rotation axis of the intermediate transfer body is stabilized, based on a time variation of information about the position of the intermediate transfer body detected by the position detection unit; and an image forming control step of causing plural of the toner image forming units to form the toner images; causing plural of the primary transfer units to perform a primary transfer; or causing the secondary transfer unit to perform a secondary transfer, during a second time interval in which the intermediate transfer body is moved at the constant speed in the direction parallel to the rotation axis of the intermediate transfer body, after causing the position correction unit to correct the forming positions of the toner images.

In another aspect, there is provided an image forming method executed by an image forming device including plural toner image forming units configured to form toner images on corresponding photosensitive bodies; plural primary transfer units configured to cause the corresponding photosensitive bodies to contact an intermediate transfer body and configured to transfer the corresponding toner images onto the intermediate transfer body; a secondary transfer unit configured to cause a recording medium to contact the intermediate transfer body and configured to transfer the toner images on the intermediate transfer body onto the recording medium; and a position correction unit configured to cause the plural toner image forming units to form predetermined patterns and configured to correct forming positions of the toner images by the corresponding toner image forming units in a direction parallel to a rotation axis of the intermediate transfer body, based on information about spacing among the patterns, the spacing among the patterns being read by a pattern reading unit.

The image forming method includes a position detection step of detecting a position of the intermediate transfer body in the direction parallel to the rotation axis of the intermediate transfer body, the position detection step being executed by a position detection unit; a position control step of controlling movement of the intermediate transfer body such that, when the position of the intermediate transfer body in the direction parallel to the rotation axis of the intermediate transfer body is moved to a target position, the position control step causes the intermediate transfer body to move to the target position at a constant speed, at least during a part of a first time interval, the movement of the intermediate transfer body being controlled by the position control step during the first time interval; a speed determination step of determining whether a speed of the intermediate transfer body in the direction parallel to the rotation axis of the intermediate transfer body is stabilized, based on a time variation of information about the position of the intermediate transfer body detected by the position detection unit, the speed determination step being executed by a speed determination unit; and an image forming control step of causing plural of the toner image forming units to form the toner images; causing plural of the primary transfer units to perform a primary transfer; or causing the secondary transfer unit to perform a secondary transfer, during a second time interval in which the intermediate transfer body is moving in the direction parallel to the rotation axis of the intermediate transfer body at the constant speed, after causing the position correction unit to correct the forming positions of the toner images, the image forming control step being executed by an image forming control unit.

In another aspect, there is provided an image forming system including at least an image forming device.

The image forming device includes plural toner image forming units configured to form toner images on corresponding photosensitive bodies; plural primary transfer units configured to cause the corresponding photosensitive bodies to contact an intermediate transfer body and configured to transfer the corresponding toner images onto the intermediate transfer body; a secondary transfer unit configured to cause a recording medium to contact the intermediate transfer body and configured to transfer the toner images on the intermediate transfer body onto the recording medium; a position detection unit configured to detect a position of the intermediate transfer body in a direction parallel to a rotation axis of the intermediate transfer body; and a position control unit configured to control movement of the intermediate transfer body, wherein, when the position control unit controls the movement of the intermediate transfer body so that the position of the intermediate transfer body in the direction parallel to the rotation axis is moved to a target position, the position control unit causes the intermediate transfer body to move to the target position at a constant speed, at least during a part of a first time interval, the movement of the intermediate transfer body being controlled by the position control unit during the first time interval.

The image forming system includes a position correction unit configured to cause the plural of the toner image forming units to form predetermined patterns and configured to correct forming positions of the toner images by the corresponding toner image forming units in a direction parallel to the rotation axis of the intermediate transfer body, based on information about spacing among the patterns, the spacing among the patterns being read by a pattern reading unit; a speed determination unit configured to determine whether a speed of the intermediate transfer body in the direction parallel to the rotation axis of the intermediate transfer body is stabilized, based on a time variation of the position of the intermediate transfer body detected by the position detection unit; and an image forming control unit configured to cause plural of the toner image forming units to form the toner images; to cause plural of the primary transfer units to perform a primary transfer; or to cause the secondary transfer unit to perform a secondary transfer, when the speed determination unit determines that the speed of the intermediate transfer body in the direction parallel to the rotation axis of the intermediate transfer body is stabilized, after causing the position correction unit to correct the forming positions of the toner images.

According to the above configurations, the downtime can be reduced even in a case where the position of the intermediate transfer belt in the width direction is rapidly changed and not stabilized.

Other objects, features and advantages of the present invention will become more apparent from the following detailed description when read in conjunction with the accompanying drawings.

BRIEF DESCRIPTION OF THE DRAWINGS

FIG. 6 is a diagram showing an example of target positions for corresponding three contacting conditions;

DETAILED DESCRIPTION OF THE PREFERRED EMBODIMENTS

The embodiments of the present invention are developed in view of a problem described below.

Figure 1A:
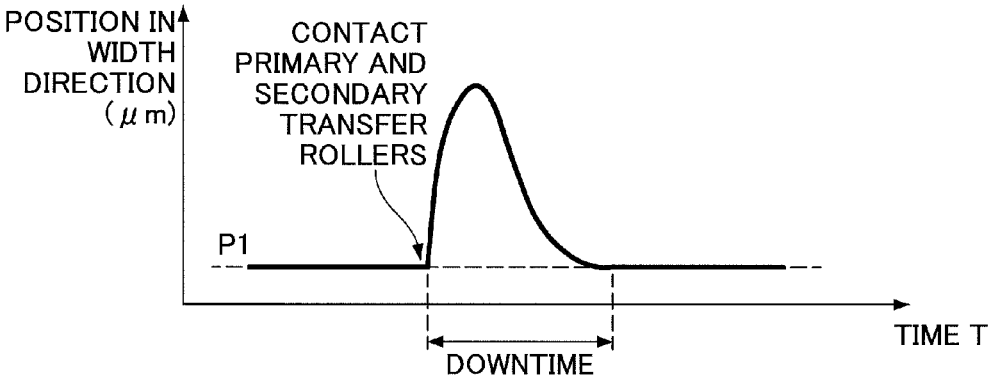
FIGS. 1A, 1B, and 1C are diagrams showing examples of downtime, when a target position in a width direction of an intermediate transfer belt is changed in a condition where a large external force is applied to the intermediate transfer belt.
Figure 1B:
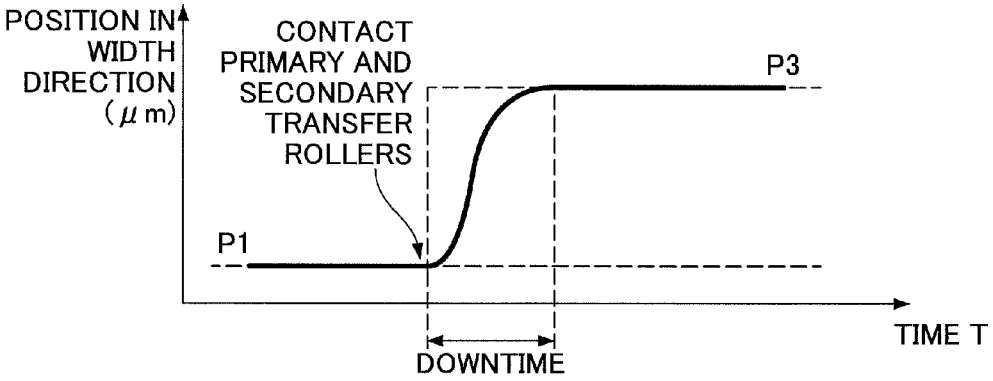
Figure 1C:
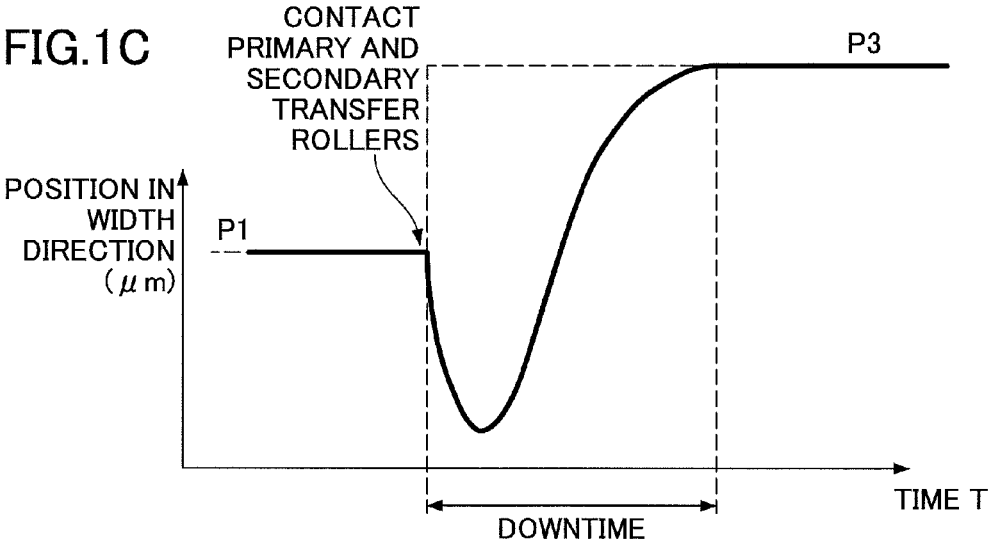

The method disclosed in Patent Document 2 has a problem that, in certain cases, the downtime is lengthened rather than reduced. FIGS. 1A, 1B, and 1C are diagrams illustrating the problem of the downtime reducing technique. FIG. 1A is a diagram showing an example of the downtime, when a target position P1 in the width direction of the intermediate transfer belt is not changed. FIG. 1B is a diagram showing an example of the downtime, when the target position in the width direction of the intermediate transfer belt is changed. Here, the condition is such that a large external force is applied to the intermediate transfer belt.

By comparing FIG. 1A with FIG. 1B, it can be found that, when the target position is changed, the downtime for the position of the intermediate transfer belt in the width direction to be stabilized is reduced.

However, it is possible that, when a large external force is applied to the intermediate transfer belt, the transfer belt moves in a direction which is opposite to the direction in which the intermediate transfer belt is supposed to be moved. In such a case, it is highly likely that the downtime is lengthened compared to the downtime of FIG. 1A.

In FIG. 1C, the position of the intermediate transfer belt in the width direction moves in the negative direction with respect to the target position P1. The coordinate value of a target position P3 in the width direction is greater than the coordinate value of the target position P1 in the width direction. Therefore, the downtime in the case of FIG. 1C, in which the target position is changed from the position P1 to the position P3, is increased compared to the downtime in the case of FIG. 1A, in which the target position P1 is not changed.

As described above, the downtime can be reduced by changing the target position, only in the cases in which the behavior of the intermediate transfer belt is known to some extent.

When an external force is applied to the intermediate transfer belt, the behavior of the intermediate transfer belt depends on the variations on balancing and shapes of various types of rollers and the photosensitive drums contacting the intermediate transfer belt. Thus the behavior of the intermediate transfer belt is significantly varied, depending on, for example, the variation on the balancing due to replacement of a component, the variation on the shapes of the components due to a change in the installation environment of the product, and the wear of the photosensitive drums.

Therefore, a method, such as the method disclosed in Patent Document 2, in which target positions in the width direction of the intermediate transfer belt in corresponding conditions are stored in a memory in advance, and one of the target positions is changed to another one of the target positions, is not so effective for reducing the downtime.

It is an objective of the embodiments to provide an image forming device that can reduce the downtime even in a condition where the position of the intermediate transfer belt in the width direction moves and is not stabilized.

Hereinafter, the embodiments are explained by referring to the figures.

[First Embodiment]

Figure 2:
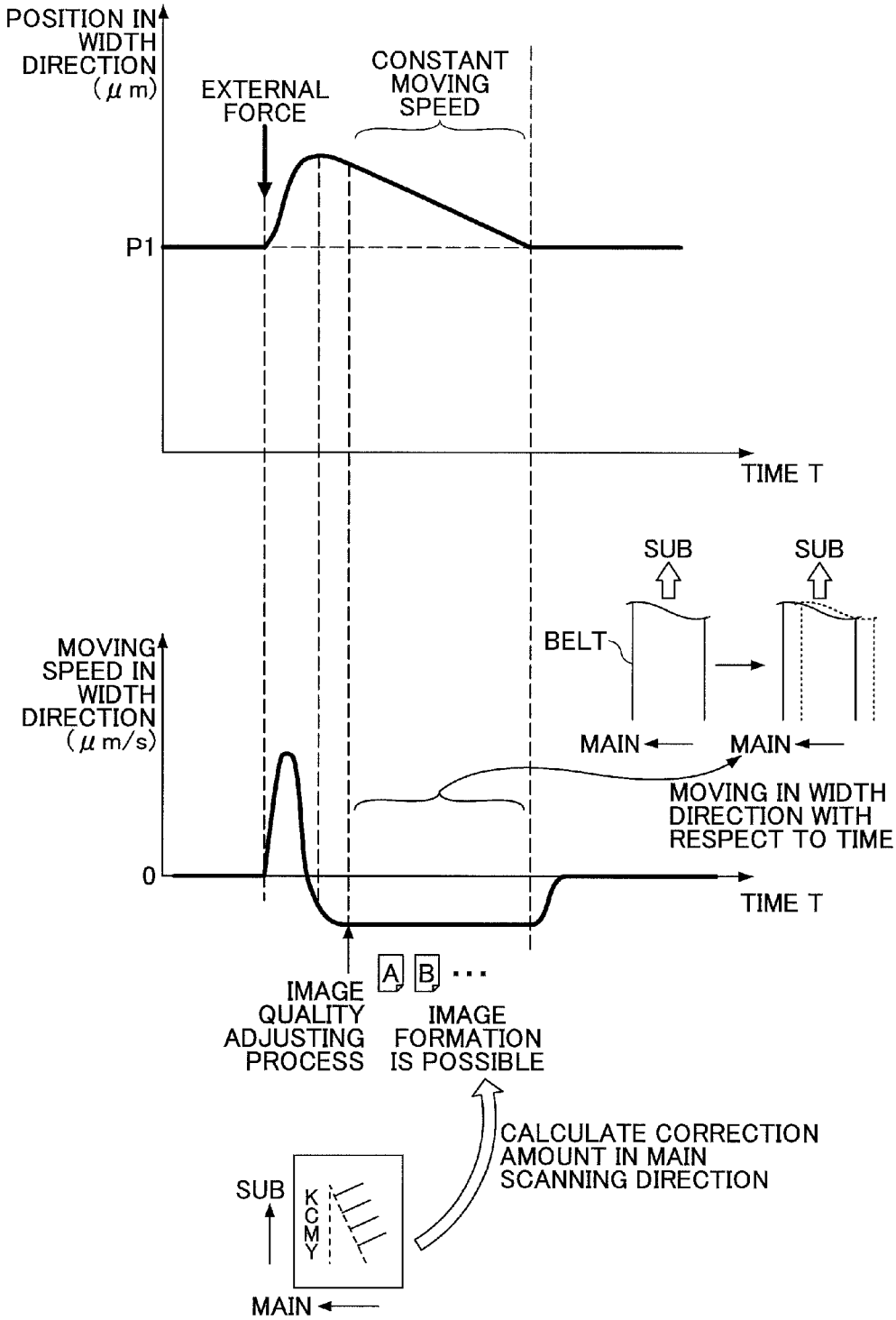
FIG. 2 is a diagram illustrating an example of controlling such that the position of the intermediate transfer belt in the width direction is moved to the target position.

FIG. 2 is a diagram illustrating an example in which a position in a width direction of an intermediate transfer belt is controlled so as to be moved to a target position. The target position in the width direction (the main scanning direction) of the intermediate transfer belt is set at P1. When the intermediate transfer belt is stabilized, the position of the intermediate transfer belt in the width direction (hereinafter, referred to as the edge position) is maintained at the target position P1, and a moving speed of the intermediate transfer belt in the width direction is almost equal to zero.

When an external force is applied to the intermediate transfer belt, it is possible that the edge position shifts from the target position P1. Thus, when an image forming device detects the shift using an edge sensor, the image forming device starts controlling the edge position, so that edge position returns to the target position P1. The speed of the edge position in the width direction becomes zero at a time that the moving amount of the edge position reaches a maximum value. After that, the speed of the edge position in the width direction becomes negative. The image forming device according to the embodiment controls the edge position so that the edge position returns to the target position P1 at a predetermined constant moving speed in the width direction.

When the intermediate transfer belt moves in the width direction, even if a yellow (Y) toner image forming unit, a magenta (M) toner image forming unit, a cyan (C) image forming unit, and a black (K) toner image forming unit form toner images at the same position in the main scanning position, the positions in the main scanning direction of the corresponding color images differ. Namely, since the intermediate transfer belt moves in the width direction during the time that the intermediate transfer belt moves a distance between the two neighboring toner image forming units in the circumferential direction, a color shift occurs in the main scanning direction.

Therefore, an image quality adjustment unit performs an image quality adjustment process. As shown in FIG. 2, the image quality adjustment unit forms evenly spaced diagonal lines in the colors of K, C, M, and Y on the intermediate transfer belt, and calculates collection amounts for preventing the toner images in the corresponding colors from being shifted, based on the distances among the diagonal lines. The correction amounts are deemed to be unchanged while the intermediate transfer belt continues moving in the width direction at the constant speed.

An image forming unit corrects, by using the correction result of the image quality adjustment unit, the positions in the main scanning direction at which the toner image forming units form the toner images in the corresponding colors. Then the image forming unit forms an image while the intermediate transfer belt moves in the width direction at a constant speed. In this manner, the image forming device according to the embodiment can form an image even when the moving speed in the width direction of the intermediate transfer belt is not equal to zero, provided that the intermediate transfer belt moves in the width direction at a constant speed.

When the image forming device causes the intermediate transfer belt to be returned to the target position P1, since the constant speed in the width direction of the intermediate transfer belt is very slow, the image forming device may form from several pages to dozens of pages of images during the time in which the moving speed in the width direction is kept constant (stabilized). Therefore, the image forming device according to the embodiment can significantly reduce the downtime compared to downtime of a conventional image forming device in which an image forming unit may not form an image until the intermediate transfer belt returns to the target position P1.

[Configuration]

Figure 3:
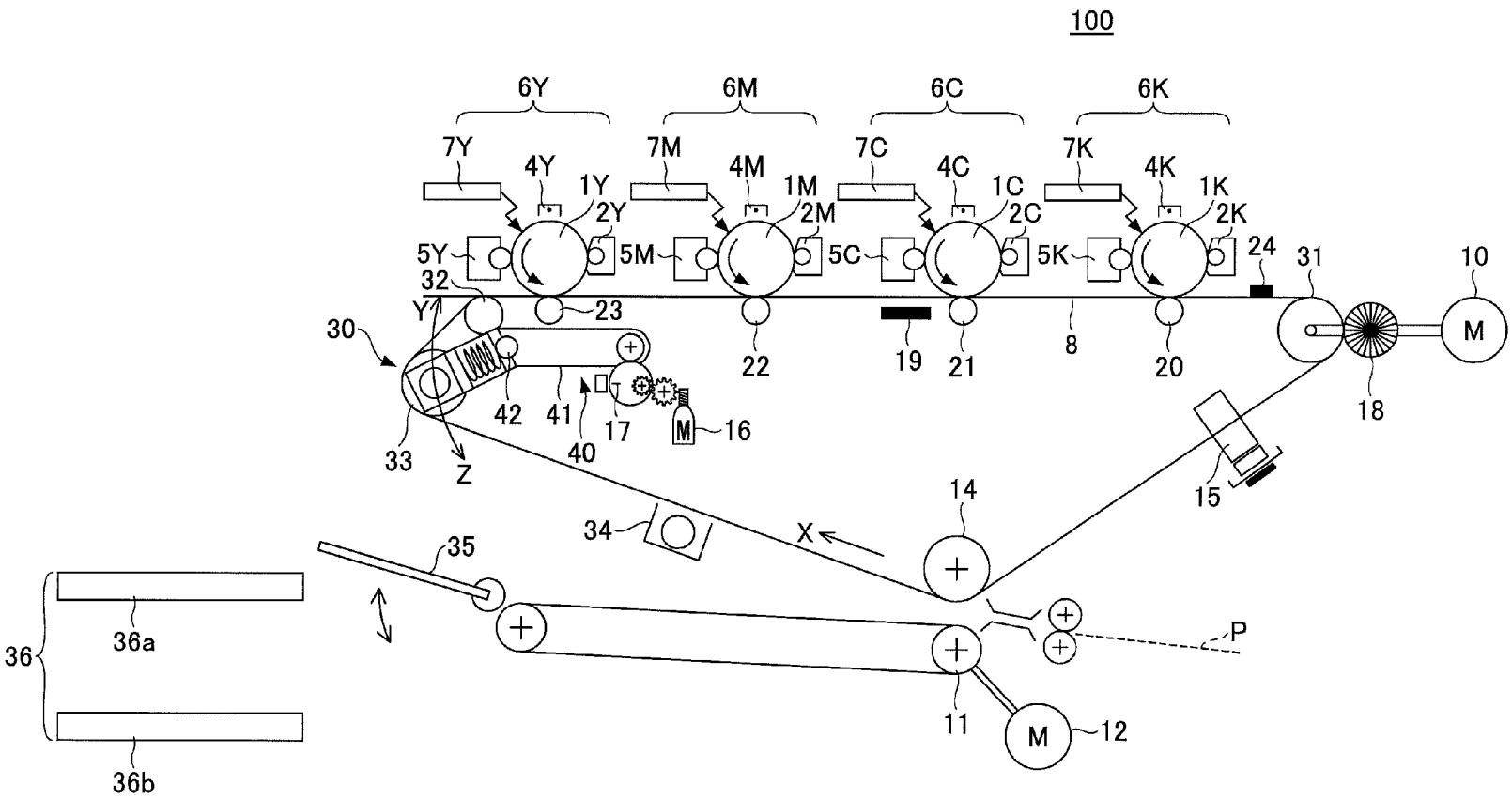
FIG. 3 is a diagram of an example of a configuration of an image forming device.

FIG. 3 is a configuration diagram of an example of the image forming device of the embodiment. Although it suffices if the image forming device 100 includes a printer function, a copy machine having a printer function, a FAX machine having a printer function, a scanner device having a printer function or a multifunction peripheral (MFP) can be regarded as examples of the image forming device 100. In FIG. 3, configurations of a scanner unit, a paper feeding unit, a paper discharging unit, or the like are omitted.

The image forming device 100 may be used in usual offices. In addition, the image forming device 100 may be used as a printer for a production market (such as for commercial printing services or in-house printing services). In the production market, due dates for printed materials are usually fixed. With the image forming device 100 according to the embodiment, many printed materials can be produced within a short time interval because the downtime is reduced and the throughput is improved. Therefore, the image forming device 100 can be used in the production market.

The image forming device 100 includes four toner image forming units 6Y, 6M, 6C, and 6K for forming yellow toner images, magenta toner images, cyan toner images, and black toner images, respectively. The toner image forming units 6Y, 6M, 6C, and 6K utilize Y toner, M toner, C toner, and K toner, whose colors are different with each other, as materials for forming images. However, the configurations of the toner image forming units 6Y, 6M, 6C, and 6K are the same, except for the colors of the toner. Therefore, the configurations of the toner image forming units 6Y, 6M, 6C, and 6K are explained by explaining the toner image forming unit 6Y for forming Y toner images as an example.

The toner image forming unit 6Y includes a laser irradiation unit 7Y, a photosensitive body 1Y having a drum shape, a drum cleaning unit 2Y, a charge neutralization unit (not shown), a charging unit 4Y, and a developing unit 5Y. The charging unit uniformly charges a surface of the photosensitive body 1Y. The photosensitive body 1Y is rotated in a counterclockwise direction in FIG. 3 by a driving unit (not shown).

The uniformly charged surface of the photosensitive body 1Y is exposed and scanned by a laser beam, and the photosensitive body 1Y supports a yellow electrostatic latent image. The yellow electrostatic latent image is developed by the developing device 5Y into a Y-toner image. Here the developing device 5Y utilizes the Y toner. Then, in accordance with rotations of the photosensitive body 1Y and an intermediate transfer belt 8, the Y-toner image is primarily transferred onto the intermediate transfer belt 8 by an electrostatic force generated by a primary transfer bias roller 23.

After the intermediate transfer process has been performed, the drum cleaning unit 2Y removes the Y toner residing on the surface of the photosensitive body 1Y. Further, the charge neutralization unit removes charges residing on the photosensitive body 1Y, which has been cleaned. By removing the charges, the surface of the photosensitive body 1Y is initialized, and the photosensitive body 1Y is prepared for next image formation.

Similarly, an M-toner image, a C-toner image, a K-toner image are formed on the photosensitive bodies 1M, 1C, and 1K in the toner image forming unit 6M, 6C, and 6K, respectively, and the toner images in the corresponding colors are intermediately transferred onto the intermediate transfer belt 8.

An intermediate transfer unit 30 is arranged below the toner image forming units 6Y, 6M, 6C, and 6K in FIG. 3. The intermediate transfer unit 30 endlessly moves the intermediate transfer belt 8, which is an intermediate transfer body, while suspending the intermediate transfer belt 8. The intermediate transfer unit 30 includes 4 primary transfer bias rollers 20 through 23, in addition to the intermediate transfer belt 8.

The intermediate transfer belt 8 is rotated (endlessly moved) in a clockwise direction in FIG. 3. The intermediate transfer belt 8 is suspended by a driving roller 31, a steering roller 33, a repulsion roller 14, and a driven roller 32. The intermediate transfer belt 8 forms an endless belt. A predetermined tension is applied to the intermediate transfer belt 8 by a tension roller (not shown). During a normal state, the intermediate transfer belt 8 and the photosensitive bodies 1Y, 1M, 1C, and 1K are separated. During formation of an image, the primary transfer bias rollers 20 through 23 individually move toward the photosensitive bodies 1Y, 1M, 1C, and 1K, depending on colors of the toner to be used. Then, the intermediate transfer belt 8 is nipped between the primary transfer bias rollers 20-23 and the photosensitive bodies 1Y, 1M, 1C, and 1K. In this manner, primary transfer nips are formed at the corresponding portions of the intermediate transfer belt 8. At that time, the primary transfer bias rollers 20 through 23 apply transfer biases having a polarization that is opposite to the polarization of the toner (for example, plus) to a rear face of the intermediate transfer belt 8 (inner surface of the loop). In this manner, the primary transfer bias rollers 20 cause the toner images to be transferred onto the intermediate transfer belt 8. Here, a printing method is well-known in which the toner images are directly transferred onto a transfer paper P without being transferred onto the intermediate transfer belt 8. Further, the toner images may be transferred onto an intermediate transfer body having a roller shape, instead of the intermediate transfer belt 8.

A scale sensor 19 for detecting a speed of the intermediate transfer belt 8 is arranged at a position inside the pathway of the intermediate transfer belt 8. Further, a toner mark sensor 24 for detecting presence or absence of a toner image and its density, and an edge sensor 15 for detecting an edge position of the intermediate transfer belt 8 are arranged at positions outside the pathway of the intermediate transfer belt 8.

The edge sensor 15 is a sensor for detecting a position in the width direction (the main scanning direction) of the intermediate transfer belt 8. The edge sensor outputs an analog signal corresponding to the edge position of the intermediate transfer belt 8. An arbitrary detection principle can be used for detecting the edge position. For example, an image processing method utilizing a fluctuation of a throughput of light, or a CCD sensor may be considered. Further, the installation position of the edge sensor is preferably in the vicinity of the edge of the intermediate transfer belt 8. However, the edge sensor may be placed in the vicinity of a center portion in the width direction of the intermediate transfer belt 8. Further, plural edge sensors 15 may be arranged. In this case, the average of the detected edge positions may be defined to be the edge position.

A secondary transfer roller 11 is separated from the intermediate transfer belt 8 in the normal state. When an image is formed, the secondary transfer roller 11 moves toward the repulsion roller 14. Then the intermediate transfer belt 8 is nipped between the secondary transfer roller 11 and the repulsion roller 14. In this manner a secondary transfer nip is formed. A conveyance path for conveying a transfer paper P toward the secondary transfer nip is provided, and a registration roller (not shown) sends out the transfer paper P at a timing in which the superposed four toner images on the intermediate transfer belt 8 reach the secondary transfer nip. The four toner images formed on the intermediate transfer belt 8 are transferred onto the transfer paper P at the secondary transfer nip.

Residual toner that has not been transferred onto the transfer paper P is adhered on a portion of the intermediate transfer belt 8 that has passed through the secondary transfer nip. A cleaning unit 34 removes the residual toner.

At the secondary transfer nip, the transfer paper P is conveyed while sandwiched between the intermediate transfer belt 8 and the secondary transfer roller 11. Here, the surfaces of the intermediate transfer belt 8 and the secondary transfer roller 11 move at the same speed. When the transfer paper P, which has been sent out from the secondary transfer nip, passes through a nip between rollers of a fixing unit (not shown), the superposed toner images in the corresponding four colors are fixed onto the transfer paper P by heat and pressure.

After passing through the fixing rollers, the transfer paper P is ejected by paper ejection rollers (not shown) onto a paper ejection tray 36. The image forming device 100 has plural paper ejection trays 36*a* and 36*b*, and the image forming device 100 arbitrarily switches between the paper ejection trays 36*a* and 36*b*. In the embodiment, a destination of paper ejection may be switched between the paper ejection tray 36*a* and the paper ejection tray 36*b* by a switching lever 35. Here, the paper ejection tray 36*a* is placed above the paper ejection tray 36*b*. A transfer paper, for which image formation has been interrupted, is ejected onto the lower paper ejection tray 36*b*.

<Steering Control>

Further, the image forming device includes a width direction position control unit 40 that tilts the steering roller 33, so as to correct the edge position of the intermediate transfer belt 8. One end of a shaft of the steering roller 33 (at the rear side of the paper surface) is rotatably connected to a fixed bearing. A point of action of a steering rod 41 functions as a bearing for supporting the other end of the shaft (the same side as the side at which the edge sensor is arranged) of the steering roller 33. The point of action of the steering rod 41 can be fluctuated in the YZ direction indicated by the arrows in FIG. 3. A point of effort of the steering rod 41 is interlocked with an eccentric cam 17, and moves in the vertical direction in accordance with motion of the eccentric cam 17. The steering rod 41 is a lever having a fulcrum 42 in the vicinity of its center portion. When the point of effort of the steering rod 41 is moved, the point of action of the steering rod 41 moves in the YZ direction. The eccentric cam 17 causes the point of effort of the steering rod 41 to move, as a steering motor 16 rotates.

When the point of effort of the steering rod 41 moves in the vertical direction, the other end of the steering roller, which is connected to the point of action, moves in the vertical direction, which is opposite to the direction in which the point of effort moves. Since one end of the steering roller 33 does not move, if the other end of the steering roller 33 moves in the vertical direction, the steering roller is relatively tilted with respect to the one end. Thus, a force is applied to the intermediate transfer belt 8. Therefore, the edge position of the intermediate transfer belt 8 can be varied by rotating the steering motor 16. When the shaft of the steering roller 33 moves in the direction of the arrow Y, a force is applied to the intermediate transfer belt 8 that causes the intermediate transfer belt 8 moving in the direction of the arrow X to move toward the rear side of the paper surface. On the other hand, when the shaft of the steering roller 33 moves in the direction of the arrow Z, a force is applied to the intermediate transfer belt 8 that causes the intermediate transfer belt 8 to move toward the front side of the paper surface. Such control of correcting the edge position is referred to as steering control.

<Steering Control and Width Direction Movement>

Figure 4:
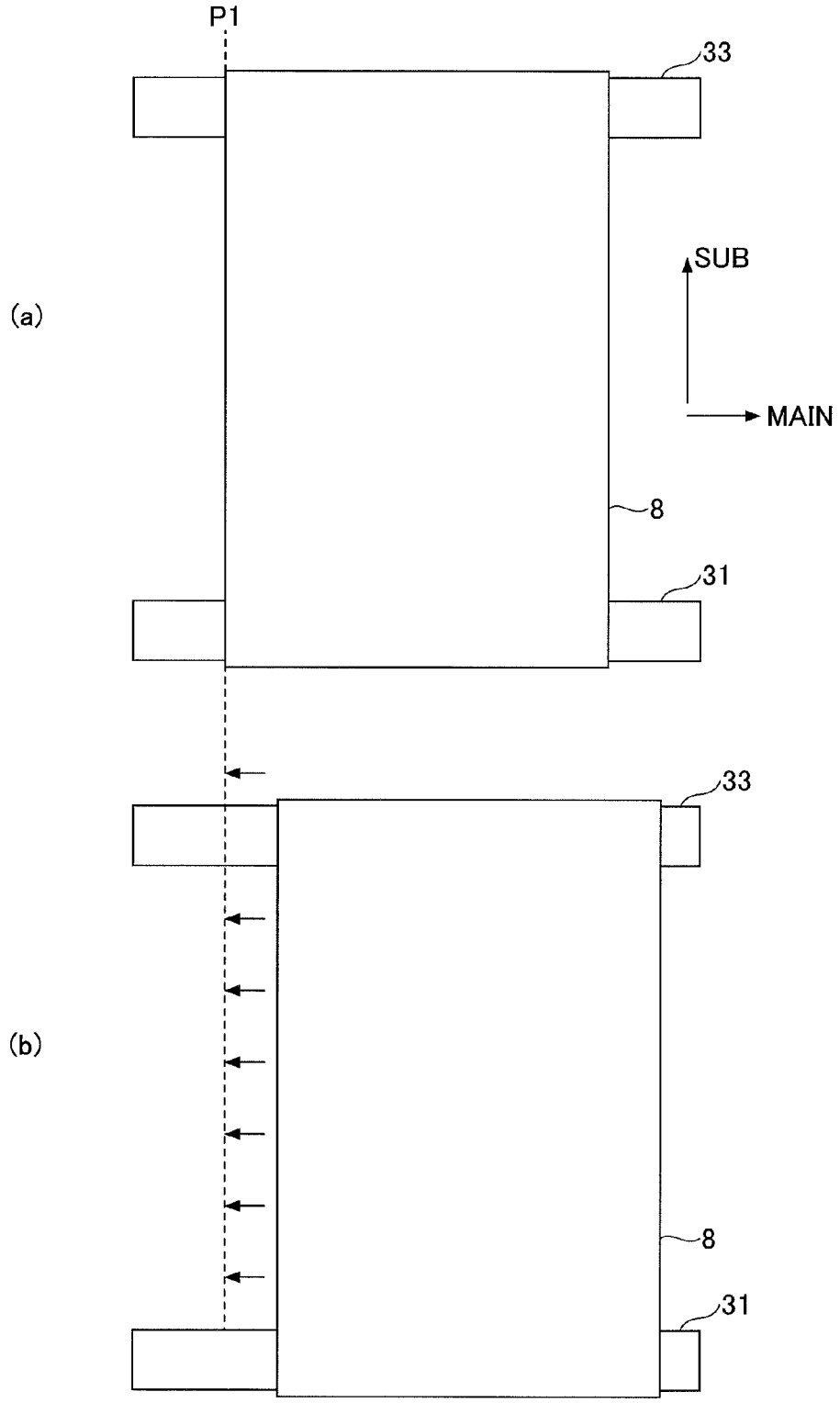
FIG. 4 is a diagram schematically illustrating an example in which the intermediate transfer belt moves in the width direction.

FIG. 4 is a diagram schematically illustrating an example of a width direction movement of the intermediate transfer belt 8. In FIG. 4, a state indicated by (a) is a state in which the edge position is not shifted. However, when a width direction movement occurs during a sequence of image forming operations, the positions of toner images are relatively shifted during a time interval in which the toner images are primarily transferred from the corresponding photosensitive drums 1Y, 1M, 1C, and 1K onto the intermediate transfer belt 8. In FIG. 4, a state indicated by (b) is a state in which the edge position of the intermediate transfer belt 8 is shifted toward right with respect to the circulating direction (the sub scanning direction) of the intermediate transfer belt 8. However, the intermediate transfer belt may be shifted toward left. The positional shift in the state (b) in FIG. 4 results in a color shift or color unevenness of an output image. Therefore, when a position shift is detected, the width direction position control unit 40 causes the steering roller 33 to tilt, so as to correct the edge position of the intermediate transfer belt 8. During the correction, the whole intermediate transfer belt 8 moves toward left without skewing.

Next, an operational procedure for forming an image using the image forming device 100 is explained. When a print start button of the image forming device 100 is pressed or when the image forming device 100 receives an instruction for printing from a personal computer (PC), the photosensitive bodies 1Y, 1M, 1C, and 1K and the secondary transfer roller 11 start rotating at almost equivalent surface speeds. The speeds of the photosensitive bodies 1Y, 1M, 1C, and 1K and the secondary transfer roller 11 are detected by motors and encoders on the shafts. The image forming device 100 applies feedback control, so that the photosensitive bodies 1Y, 1M, 1C, and 1K and the secondary transfer roller 11 rotate at a same constant speed.

The image forming device 100 applies feed back control to an intermediate transfer motor 10 of the intermediate transfer belt 8 using a speed detection result by an encoder 18 attached to the driving roller 31 and a belt speed detection result by the scale sensor 19, so that the intermediate transfer belt 8 is rotated at a constant speed.

After that, when an image to be formed is a monochrome image, the primary transfer bias roller 20 for the black color moves in upward direction, and the intermediate transfer belt 8 contacts the photosensitive body 1K. On the other hand, when an image to be formed is a color image, all the primary transfer bias rollers 20 through 23 corresponding to the colors move in upward direction, and all the photosensitive bodies 1Y, 1M, 1C, and 1K contact the intermediate transfer belt 8. At almost the same time, the secondary transfer roller 11 moves in upward direction, and the secondary transfer roller 11 contacts the intermediate transfer belt 8.

After the primary transfer bias rollers 20 through 23 and the secondary transfer roller 11 have contacted the intermediate transfer belt 8, the toner image forming units 6Y, 6M, 6C, and 6K form toner images in the corresponding colors on the photosensitive bodies 1Y, 1M, 1C, and 1K, and the toner images are primarily transferred onto the intermediate transfer belt 8. Here, the toner images correspond to an image to be formed. Around the timing of forming the toner images, the transfer paper P is conveyed from a paper feed tray (or a manual feed tray), and at a timing in which the toner images transferred onto the intermediate transfer belt 8 approach the secondary transfer roller 11 and the repulsion roller 14, the transfer paper P is sent to the nip between the secondary transfer roller 11 and the repulsion roller 14. Between the secondary transfer roller 11 and the repulsion roller 14, the superposed toner images on the intermediate transfer belt 8 are secondarily transferred onto the transfer paper P.

When all the images of pages included in a single print job are monochrome images or when all the images of pages included in a single print job are color images, operations for contacting the primary transfer bias rollers 20 through 23 and the intermediate transfer belt 8 and operations for separating the primary transfer bias rollers 20 through 23 from the intermediate transfer belt 8 are not performed until the image formation for all the pages is completed.

However, for a print job in which monochrome images and color images coexist depending on a page, 3 primary transfer bias rollers among the primary transfer bias rollers 20 through 23, except for the primary transfer bias roller 20 for the color of black, there is repeated contacting and separating from the intermediate transfer belt 8. For example, when a previous image is a monochrome image and a next image is a color image, the primary transfer bias rollers 21, 22, and 23 for color images are kept separated from the intermediate transfer belt 8, until the primary transfer of the monochrome image is completed. After the primary transfer of the monochrome image has been completed, the primary transfer bias rollers 21, 22, and 23 for color images contact the intermediate transfer belt 8, and a color image is formed. When the primary transfer bias rollers 21, 22, and 23 contact and separate from the intermediate transfer belt 8, external forces are generated and the intermediate transfer belt 8 may be moved in the width direction.

Figure 5A:
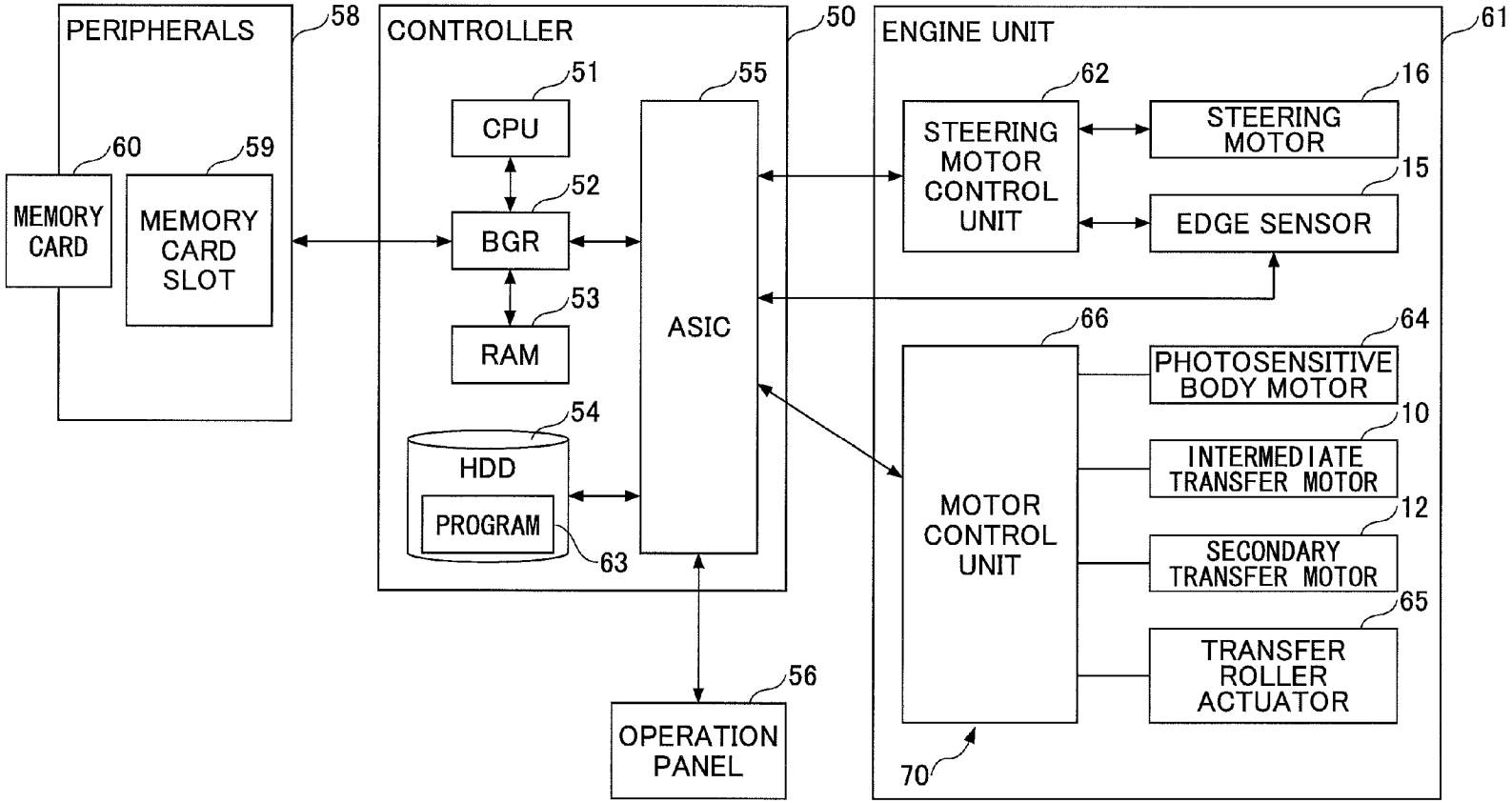
FIG. 5A is a diagram showing an example of a hardware configuration of the image forming device.

FIG. 5A is a diagram showing an example of a hardware configuration of the image forming device. The image forming device 100 includes a controller 50, peripherals 58, an operations panel 56, and an engine unit 61. The controller 50 is responsible for overall control of the image forming device 100. The controller 50 mainly includes a CPU 51, a bridge (BRG) 52, a system memory (RAM) 53, an ASIC 55, and a hard disk drive (HDD) 54.

The CPU 51 is an integrated circuit (IC) for performing information processing. The CPU 51 executes an application program or a service program for providing a service on a per-process basis in parallel by an operating system (OS), such as UNIX (registered trademark). The ASIC 55 is an IC for image processing. The BRG 52 is a bridge for connecting the peripherals 58 (such as a memory card slot 59, a network interface controller (NIC), and a USB device) to the controller 50.

The HDD 54 is a storage unit connected to the ASIC 55. The HDD 54 is utilized for storing images, documents, programs, font data, form data, or the like. The HDD 54 stores a program 63 for performing the steering control, the image quality adjustment, and the image formation. The program 63 may be distributed in a memory card 60 storing the program 63, or may be distributed from a server (not shown).

The operations panel 56 is hardware (an operation unit) for an operator to operate the image forming device 100. At the same time, the operations panels 56 is hardware (a display unit) for the image forming device 100 to provide visual information, such as a menu or a state, to the operator. The operations panel 56 is connected to the ASIC 55.

The engine unit 61 is connected to the ASIC 55 through a Peripheral Component Interconnect (PCI) bus. The engine unit 61 corresponds to the motors and the devices driven by the motors, which are described in the explanation related to FIG. 2. However, in FIG. 5A, the engine unit 61 is divided into a control system of the steering motor 16 and a control system for forming images, for the sake of explanation. When the edge sensor 15 detects a shift of the intermediate transfer belt 8 in the width direction, a steering motor control unit 62 controls the intermediate transfer belt 8 to move to the target position at a constant speed (uniform velocity). The constant speed may be determined in advance. Alternatively, the CPU 51 may specify the constant speed based on an amount of the shift from the target position. An image forming engine 70 includes a motor control unit 66, a photosensitive body motor 64, the intermediate transfer motor 10, a secondary transfer motor 12, and a transfer roller actuator 65. The motor control unit 66 controls various motors. The photosensitive body motor 64 rotationally drives the photosensitive body 1. The transfer roller actuator 65 causes the primary transfer bias rollers 20 through 23 to contact or separate from the intermediate transfer belt 8, and causes the secondary transfer roller 11 to contact or separate from the intermediate transfer belt 8.

Figure 5B:
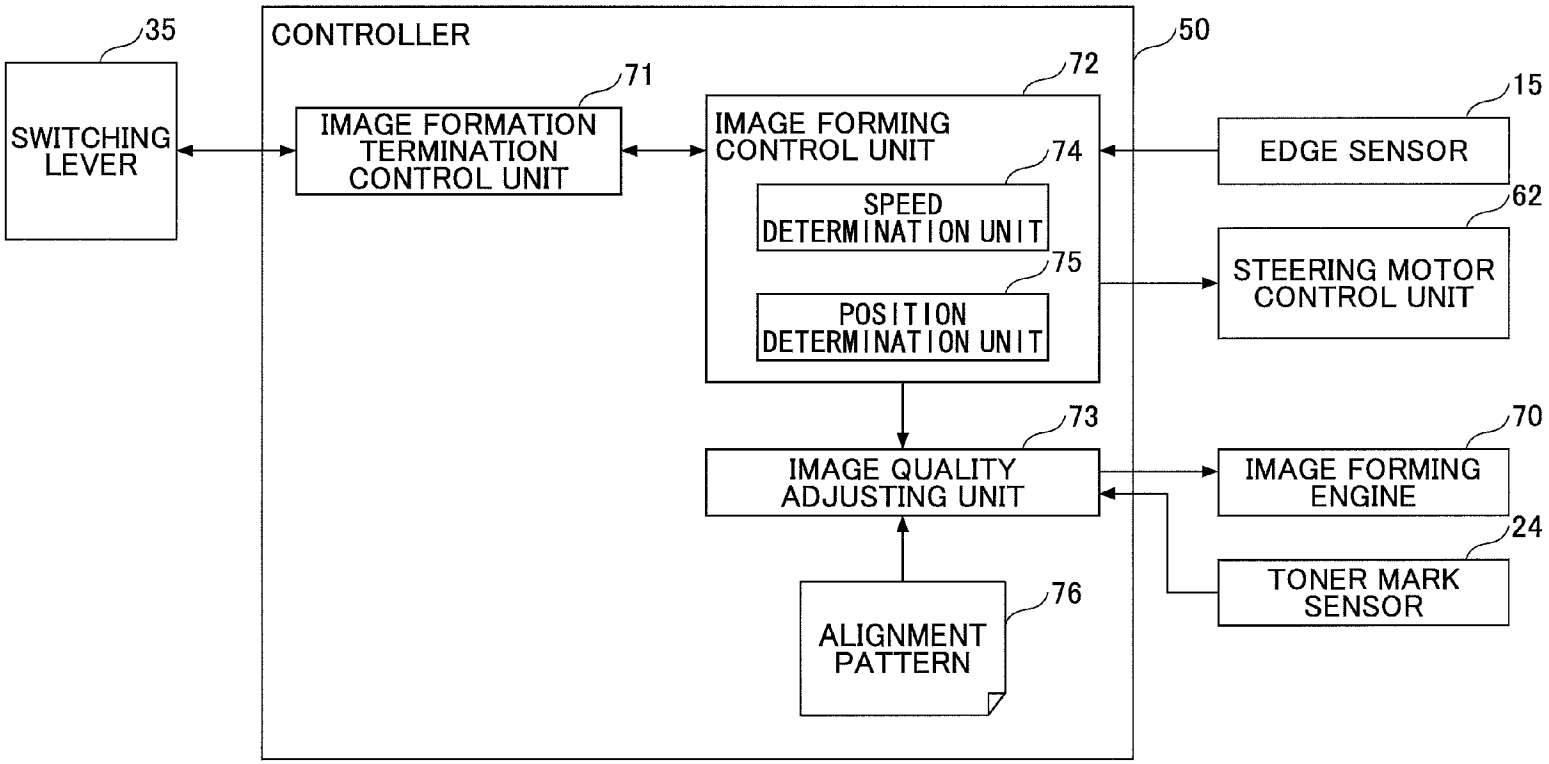
FIG. 5B is a diagram showing an example of functional blocks of the image forming device.

FIG. 5B is a diagram showing an example of functional blocks of the image forming device. Functions within the controller 50 are realized, for example, by executing the program 63 with the CPU 51. An image forming control unit 72 controls rotation speeds of the motors and causes the primary transfer bias rollers 20 through 23 and the secondary transfer roller 11 to contact or separate from the intermediate transfer belt 8 by controlling the image forming engine 70. In addition, the image forming control unit 72 forms images by controlling the toner image forming units 6Y, 6M, 6C, 6K and the like. When a contacting state or a separating state of any of the primary transfer bias rollers 20 through 23 and the secondary transfer roller 11 is changed, the image forming control unit 72 causes the steering motor control unit 62 to start the steering control.

A speed determination unit 74 detects a speed in the width direction of the intermediate transfer belt 8, based on variation of the edge position detected by the edge sensor 15 with respect to time, and determines whether the moving speed in the width direction is stabilized. A position determination unit 75 determines whether the edge position is stabilized at the target position, based on the edge position detected by the edge sensor 15.

An image quality adjusting unit 73 causes the image forming engine unit 70 to form an alignment pattern 76 on the intermediate transfer belt 8, and performs an image quality adjusting process (position correction and density correction) based on a result of detecting the alignment pattern 76 with the toner mark sensor 24.

When the speed determination unit 74 determines that the moving speed in the width direction is not constant, an image formation termination control unit 71 switches a destination where a transfer paper, on which an image may have been formed in the state such that the moving speed in the width direction is not constant, is to be ejected by switching the switching lever 35.

[Steering Control]

First, a target position in steering control is explained. The image forming device 100 according to the embodiment has three states depending on whether the primary transfer bias rollers 20 through 23 and the secondary transfer roller 11 contact the intermediate transfer belt 8. Hereinafter the three states are referred to as contact states. However, transient states, in which the primary bias transfer rollers 20 through 23 and the secondary transfer roller 11 contact and separate from the intermediate transfer belt 8, are not considered here.

Waiting state (all the primary bias transfer rollers 20 through 23 and the secondary transfer roller 11 separate from the intermediate transfer belt 8)

Monochrome mode state (the primary bias transfer roller 20 for the color of black and the secondary transfer roller contact the intermediate transfer belt 8)

Color mode state (all the primary bias transfer rollers 20 through 23 and the secondary transfer roller 11 contact the intermediate transfer belt 8) As a conventional technique, a technique is known in which the target position in the width direction of the intermediate transfer belt 8 is switched among the positions P1 through P3 of the intermediate transfer belt 8.

FIG. 6 is a diagram illustrating an example of the target positions for the three states. In FIG. 6, the target position for the waiting state is P1, the target position for the monochrome mode state is P2, and the target position for the color mode state is P3. In this manner, by setting the target positions for the contact states, time required for starting image formation can be reduced.

Figure 7:
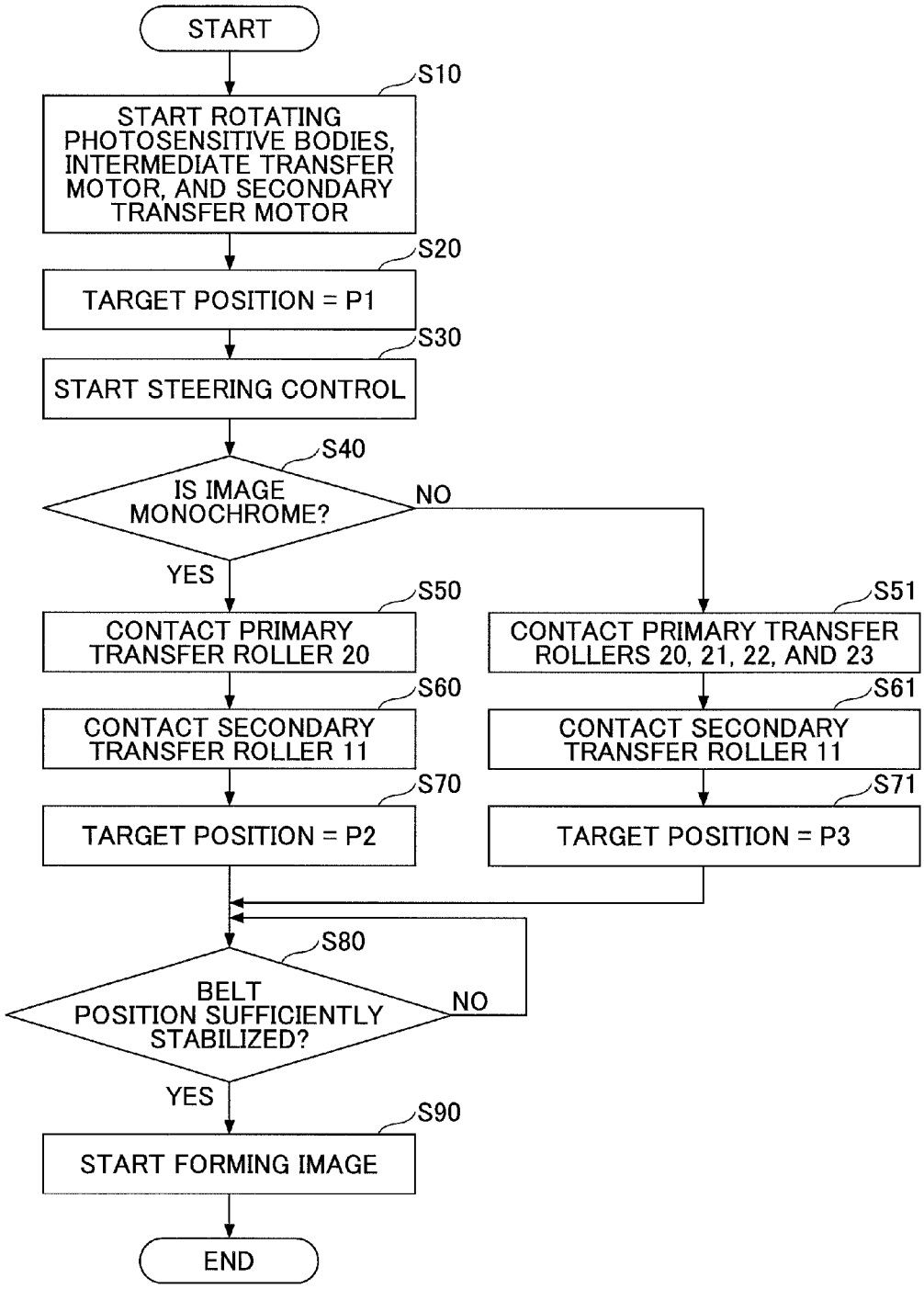
FIG. 7 is a flowchart illustrating an example of timing for image formation and steering control.

Next, conventional steering control is explained. In a conventional technique, an image forming operation is kept stopped until the steering operation is terminated and the edge position of the intermediate transfer belt reaches the target position. FIG. 7 is a flowchart illustrating an example of the timing in which the image formation and the steering control are performed according to a conventional technique. The processing of FIG. 7 is started when the controller 50 receives an instruction of an operation through the operations panels 56, or, when the controller 50 receives a print job from a PC (not shown).

Prior to starting the image formation, the photosensitive bodies 1Y, 1M, 1C, and 1K, the intermediate transfer motor 10, and the secondary transfer motor 12 are stopped, and the primary transfer bias rollers 20 through 23 and the secondary transfer roller 11 are separated from the intermediate transfer belt 8.

When the controller 50 starts performing the job, the photosensitive bodies 1Y, 1M, 1C, and 1K, the intermediate transfer motor 10, and the secondary transfer motor 12 start rotating (S10).

At the timing of step S10, since the primary transfer bias rollers 20 through 23 and the secondary transfer roller 11 are separated from the intermediate transfer belt 8, the steering motor control unit 62 sets the target position in the width direction of the intermediate transfer belt 8 to be the target position P1 for the waiting state (S20). With this setting, the steering motor control unit 62 starts the steering control (S30).

Subsequently, the controller 50 determines as to whether the image data of the page to be printed is monochrome data (S40). The controller 50 determines whether the image data is monochrome data, based on the content of the operation through the operations panel 56, the print condition that has been received from the PC, or pixel values of the image data.

When the image data is the monochrome data (S40: Yes), the controller 50 causes only the primary transfer bias roller 20 for the color of black to contact the intermediate transfer roller 8 (S50). Namely, since the primary transfer rollers 21 through 23 for the colors of C, M, and Y are not utilized, they do not contact the intermediate transfer belt 8.

Further, the controller 50 causes the secondary transfer roller 11 to contact the intermediate transfer belt 8 (S60). Since the contact state becomes the monochrome mode state through steps S50 and S60, the steering motor control unit 62 changes the target position in the width direction of the intermediate transfer belt 8 to the target position P2 (S70).

Since the steering motor control unit 62 performs the steering control with respect to the target position P2, the edge position of the intermediate transfer belt 8 is controlled to be the target position P2.

At step S40, when the image data is the color data (S40: No), the controller 50 causes the primary transfer bias rollers 20 through 23 for the colors of B, C, M, and Y to contact the intermediate transfer belt 8 (S51). Further, the controller 50 causes the secondary transfer roller 11 to contact the intermediate transfer belt 8 (S61). Since the contact state becomes the color mode state through steps S51 and S61, the steering motor control unit 62 changes the target position in the width direction of the intermediate transfer belt 8 to the target position P3 (S71).

Since the steering motor control unit 62 performs the steering control with respect to the target position P3, the edge position in the width direction of the intermediate transfer belt 8 is controlled to be the target position P3.

Then the controller waits for the position in the width direction of the intermediate transfer belt 8 to be sufficiently stabilized (S80). When the position is sufficiently stabilized, the controller 50 causes the engine unit 61 to start forming the image (S90). The controller 50 determines that the width direction of the intermediate transfer belt 8 is sufficiently stabilized when the edge position is within a predetermined distance from the target position P2 or from the target position P3, or when the time variation of the edge position is within a predetermined range.

<Width Direction Speed Control During Steering Control>

Conventionally, the edge position is not controlled so that the moving speed in the width direction is constant. However, in the embodiment, when the edge position is controlled, the moving speed in the width direction is controlled so as to maintain a constant speed.

Figure 8:
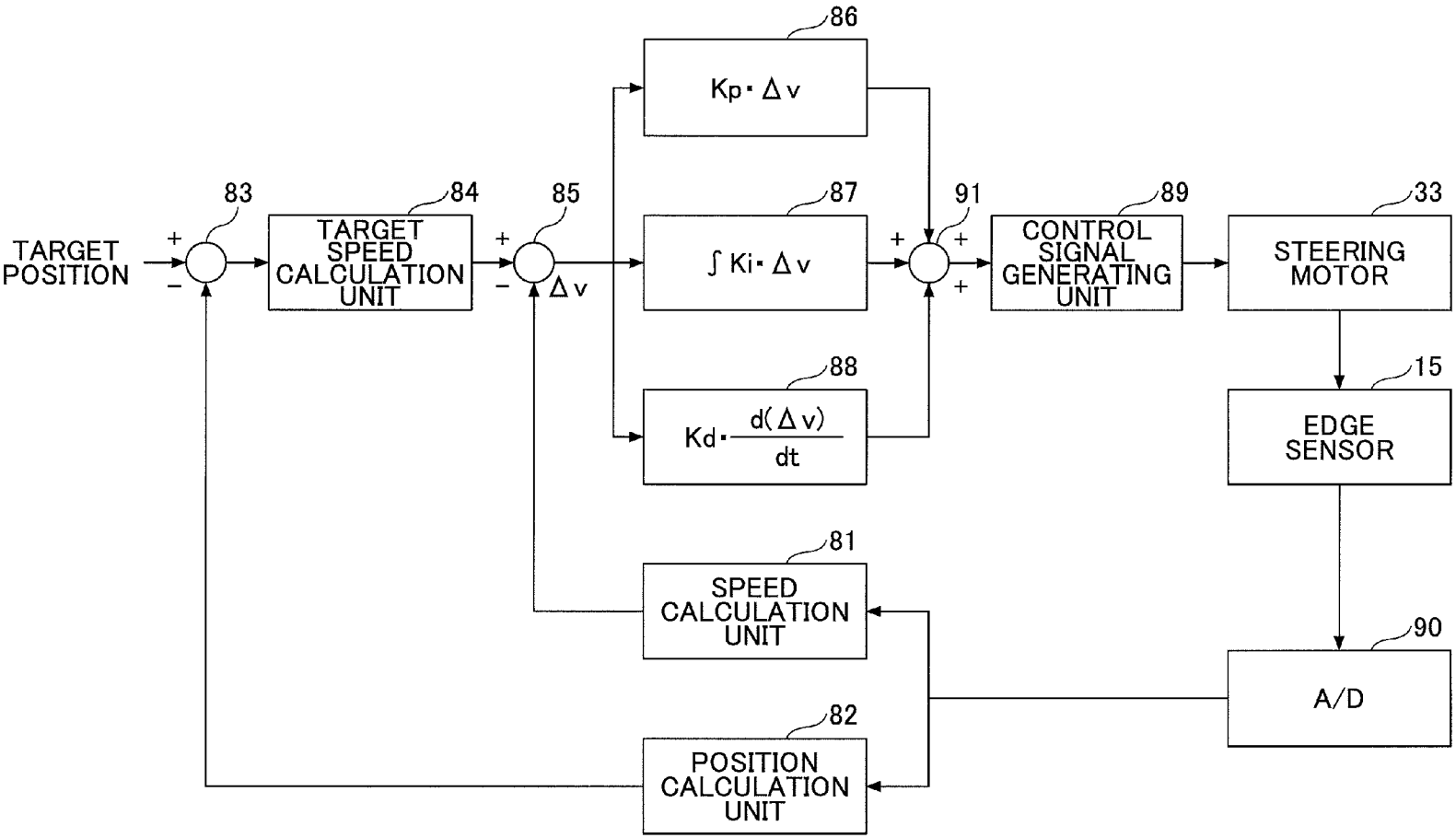
FIG. 8 is a diagram of an example of control blocks of a steering motor control unit.

FIG. 8 is a control block diagram of the steering motor control unit 62. The control block diagram of FIG. 8 may be a control block diagram of PID feedback control or PI control. The edge sensor 15 detects the edge position of the intermediate transfer belt 8 and outputs an analog signal corresponding to the edge position to an A/D convertor 90. Here, when the edge portion of the intermediate transfer belt 8 is flat, the analog signal is equivalent to the positional shift of the edge position of the intermediate transfer belt 8. However, actually, the edge portion of the intermediate transfer belt 8 has concave portions and convex portions due to the production process or the shaping process. In such a case, data of the shape of the edge portion of the intermediate transfer belt 8 may be added to the output of the edge sensor 15.

The A/D convertor 90 converts the analog signal into a digital signal, and outputs the digital signal to a speed calculation unit 81 and a position calculation unit 82. The position calculation unit 82 removes noise components from the digital signal by averaging and smoothing plural digital signal values, and calculates the stabilized edge position of the intermediate transfer belt 8.

A first subtracter 83 computes a difference between each of the target positions P1 through P3 specified by the controller 50 and the edge position calculated by the position calculation unit 82. A target speed calculation unit 84 calculates a target speed based on the difference between two positions output from the first subtracter 83. In the embodiment, since the moving speed in the width direction is set to a constant speed, the target speed becomes as follows, in the simplest case.

If the difference is almost equal to zero, the target speed is equal to zero; and if the difference is not equal to zero, the target speed is v (a constant).

Further, the target speed being constant does not require that the target speed is always equal to the constant value v regardless of the difference between two positions. It suffices that speed in the width direction of the edge position of the intermediate transfer belt 8 is constant during the time that the edge position returns to any of the target positions P1 through P3. Therefore, the target speed calculation unit 84 may vary the constant target speed depending on the difference between the two positions immediately after the contact state has been changed. In this manner, for example, when the difference between the two positions is large immediately after the contact state has been changed, the time required for the edge position to return to the target position may be controlled by increasing the target speed. Further, in such a case, the controller 50 sets a table indicating the relationship between the difference between the two positions and the target speed in the steering motor control unit 62.

The speed calculation unit 81 calculates the moving speed in the width direction of the intermediate transfer belt 8 from plural digital signal values in a time series. Similar to the case of the calculation of the position, the speed calculation unit 81 removes noise components by averaging and smoothing the speed, and calculates the speed in the width direction of the intermediate transfer belt 8.

A second subtracter 85 calculates a speed difference Δv between a target speed calculated by the target speed calculation unit 84 and a speed calculated by the speed calculation unit 81. The speed difference Δv is input to a proportional element calculation unit 86, an integral element calculation unit 87, and a differential element calculation unit 88.

The proportional element calculation unit 86 calculates a proportional element by multiplying the speed Δv by a gain Kp. The integral element calculation unit 87 calculates an integral element by multiplying the speed Δv by a gain Ki. The differential element calculation unit 88 calculates a differential element by multiplying a difference between a previous speed Δv, which is immediately before the current speed Δv, and the current speed Δv by a gain Kd.

The values output from the proportional element calculation unit 86, the integral element calculation unit 87, and the differential element calculation unit 88 are added by an adder 91. A control signal generating unit 89 generates a control signal depending on a result of addition by the adder 91. Since the control signal is, for example, a pulse width modulation (PWM) signal, the control signal generating unit 89 generates a PWM signal having a duty ratio corresponding to the result of the addition.

With this, the steering motor 16 is controlled so that the intermediate transfer belt 8 is moved with a constant moving speed in the width direction, until the edge position of the intermediate transfer belt 8 reaches the corresponding one of the target positions P1 through P3.

[Image Quality Adjusting Process]

It has conventionally been known that the image forming device 100 performs an image density correction and a color correction when a number of formed images exceeds a constant number, so as to suppress a color shift. Hereinafter, the above adjustments are referred to as an image adjusting process.

The image quality adjusting unit 73 performs the image adjusting process in response to an instruction from the image forming control unit 72. As described above, the image quality adjusting unit 73 adjusts the drawing positions and the density by correcting forming positions of the toner images in the corresponding colors and the density of each of the toner images, so that the toner images having the proper density are formed at the corresponding proper positions. The image quality adjusting unit 73 forms toner images of the specific alignment pattern 76 on the photosensitive bodies 1Y, 1M, 1C, and 1K, and obtains position information and density information of the toner images on the intermediate transfer belt 8 which has been read by the toner mark sensor 24. The toner mark sensor 24 reads the positions and the densities of the formed toner images of the alignment pattern 76 and feeds back the detection results, and the image quality adjusting unit 73 determines the positions on the photosensitive bodies 1Y, 1M, 1C, and 1K, where the corresponding toner images are to be formed, and the amount of the toner.

Figure 9:
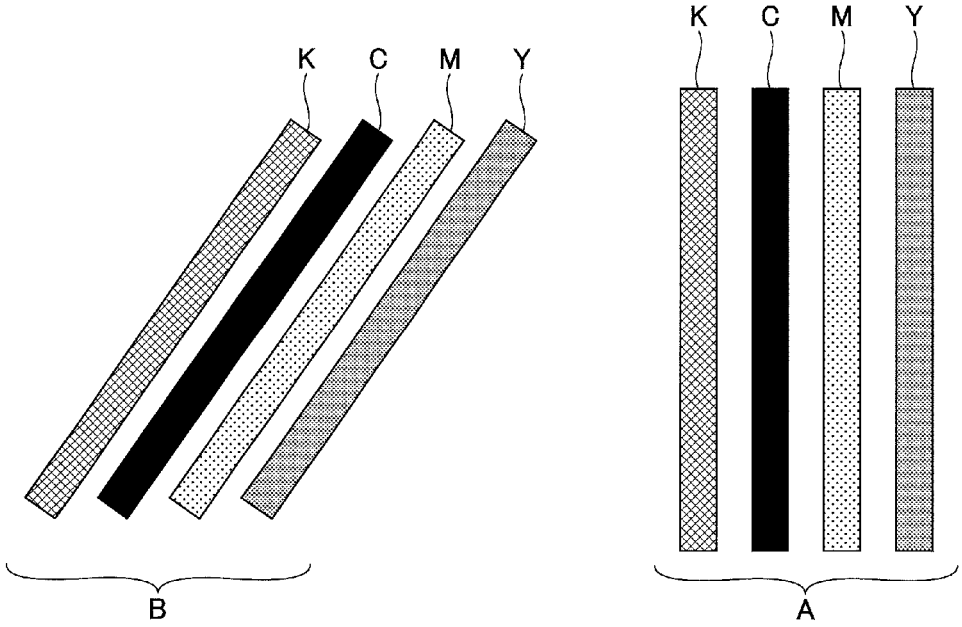
FIG. 9 is a diagram showing examples of alignment patterns.

FIG. 9 shows an example of the alignment pattern 76. The alignment pattern 76 is formed of lines in the colors of Y, M, C, and K. Idealistically, all the distances between the neighboring lines in the alignment pattern A and the alignment pattern B are equal. One alignment pattern 76 includes the alignment pattern A including lines in the colors of Y, M, C, and K, which are perpendicular to the moving direction of the intermediate transfer belt 8, and the alignment pattern B including lines in the colors of Y, M, C, and K, which are rotated slightly from the moving direction of the intermediate transfer belt 8. The alignment pattern A is a pattern for correcting the color shifts in the sub-scanning direction, and the alignment pattern B is a pattern for correcting the color shifts in the main scanning direction. Since the alignment pattern B is the set of the oblique parallel lines, if there exist color shifts in the main scanning direction, the distances between the neighboring lines vary. Therefore, by detecting the distances between the neighboring oblique lines of the alignment pattern B, the color shifts in the main scanning direction of the intermediate transfer belt 8 can be detected.

In each of the alignment patterns A and B, the lines are formed in the order of K, C, M, and Y, when the lines are viewed from the front in the circulating direction of the intermediate transfer belt 8. However, this order is an example, and the order can be changed depending on the design. The image quality adjusting unit 73 forms the alignment patterns A and B at an end portion in the width direction of the intermediate transfer belt 8, and corrects the color shifts based on the formed positions of the toner images in the width direction. Further, the image quality adjusting unit 73 forms plural of the alignment patterns A and B in the circulating direction of the intermediate transfer belt 8, and corrects the color shifts based on the formed positions of the toner images in the circulating direction.

The toner mark sensor 24 is arranged at a position facing the position on the intermediate transfer belt 8 where the alignment pattern 76 is formed. The toner mark sensor 24 includes, for example, a light emitting element and a light receiving element. The toner mark sensor 24 converts the light reflected from the alignment pattern 76 into an electric voltage and compares the electric voltage with a threshold value. Since the electric voltage value sequentially exceeds the threshold value by the reflected light from the corresponding four lines, the image quality adjusting unit 73 records time values at which the electric voltage value exceeds the threshold value. Namely, totally 8 time values are obtained by the alignment patterns A and B. Further, the voltage values at the corresponding times are also recorded.

The image quality adjusting unit 73 measures the detection time values of detecting the second through the fourth lines while using the detection time value of detecting the first line (K) as a first reference value. Similarly, the image quality adjusting unit 73 measures the detection time values of detecting the sixth through the eighth lines while using the detection time value of detecting the fifth like (K) as a second reference value. Since the time values correlate with the distances between the neighboring lines, the position of each of the lines in the circulating direction of the intermediate transfer belt 8 and the position of each of the lines in the width direction of the intermediate transfer belt 8 can be calculated from the time values at which the corresponding lines are detected. By comparing the calculated positions with the reference positions, shifted amounts in the circulating direction and in the width direction can be obtained.

The image quality adjusting unit 73 corrects the positions in the circulating direction at which the toner images in the colors of C, M, and Y are formed by comparing the target control values of the time intervals in the circulating direction (target distances between the line in the color of K, which is used as the reference position, and the lines in the colors of C, M, and Y in the circulating direction) and the measured time intervals of the alignment pattern A. Similarly, the image quality adjusting unit 73 corrects the positions in the width direction at which the toner images in the colors of C, M, and Y are formed by comparing the target control values of the time intervals in the width direction (target distances between the line in the color of K, which is used as the reference position, and the lines in the colors of C, M, and Y in the width direction) and the measured time intervals of the alignment pattern B.

Further, the image quality adjusting unit 73 corrects the amounts of the toner adhered to the corresponding photosensitive bodies 1K, 1C, 1M, and 1Y by comparing the electric voltage values indicating the lines in the corresponding colors of the alignment pattern 76 and the target electric voltage values (voltage values for the target density).

Figure 10A:
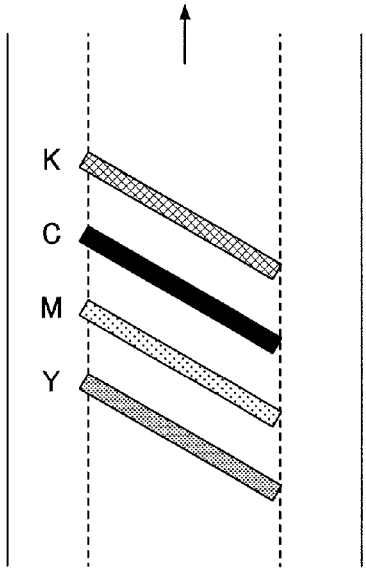
FIGS. 10A and 10B are diagrams illustrating the alignment patterns formed when the intermediate transfer belt is moving.

In this manner, if the alignment pattern 76 is formed again, after the image quality adjusting unit 73 corrects the positions in the main scanning direction, where the toner images are to be formed, the start points in the main scanning direction of the lines in the alignment pattern B coincide with each other and the end points in the main scanning direction of the lines in the alignment pattern B coincide with each other. FIG. 10A shows an example of the alignment pattern B in which the start points in the main scanning direction of the lines coincide with each other and the end points in the main scanning direction of the lines coincide with each other.

Contrary to this, when the intermediate transfer belt 8 is moving in the width direction at a constant speed, the start points of the lines in the alignment pattern B do not coincide with each other and the end points of the lines in the alignment pattern B do not coincide with each other, even if the image quality adjusting unit 73 has corrected the positions in the main scanning direction, where the toner images are to be formed.

Figure 10B:
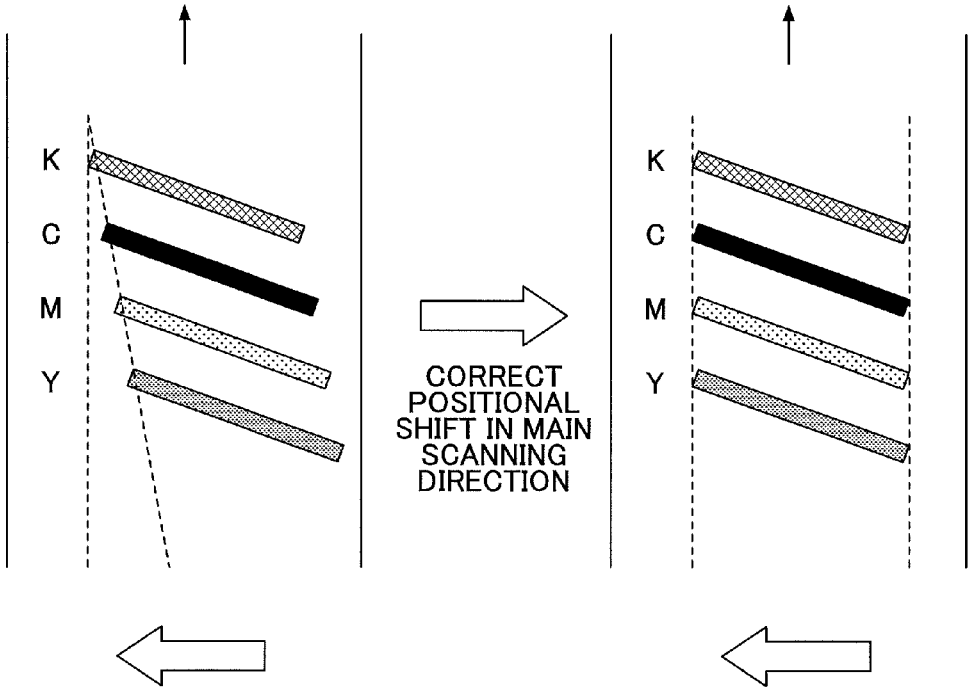

FIG. 10B is a diagram showing an example of the alignment pattern B, which is formed when the intermediate transfer belt 8 is moving in the width direction at a constant speed. For example, when the intermediate transfer belt 8 is moving toward left with respect to the circulating direction, the positions of the lines in the colors of K, C, M, and Y of the alignment pattern B are gradually shifted toward right, as shown in the left hand side in FIG. 10B. The shifts of the formed positions in the main scanning direction occur during formation of the image to be printed. Therefore, in the embodiment, the image quality adjusting unit 73 performs an image quality adjusting process while the intermediate transfer belt 8 is being moved in the width direction at a constant speed by the steering control. In this manner, color shifts in the main scanning direction due to the movement of the intermediate transfer belt 8 in the width direction are suppressed.

Now, suppose that the image quality adjusting unit 73 corrects the positions while the intermediate transfer belt 8 is moving at a constant speed, and the alignment pattern 76 is formed again. In this case, as shown in the right hand side in FIG. 10B, the start points in the main scanning direction of the lines in the alignment pattern B coincide with each other and the end points in the main scanning direction of the lines in the alignment pattern B coincide with each other, even if the intermediate transfer belt 8 is moving at the constant speed. Therefore, the color shifts in the main scanning direction that occur during formation of an image to be printed can be suppressed, provided that the image forming device 100 forms the image by using the result of the positional corrections during the time in which the intermediate transfer belt 8 is moving at the constant speed.

[Image on the Intermediate Transfer Belt]

Even if the image quality adjusting unit 73 performs the image quality adjusting process during the time in which the intermediate transfer belt 8 is moving at the constant speed, the intermediate transfer belt 8 is still moving in the width direction at the constant speed during the formation of the image. Therefore, the original image is deformed on the intermediate transfer belt 8. However, this deformation is canceled during the time in which the image is transferred onto the transfer paper.

Figure 11A:
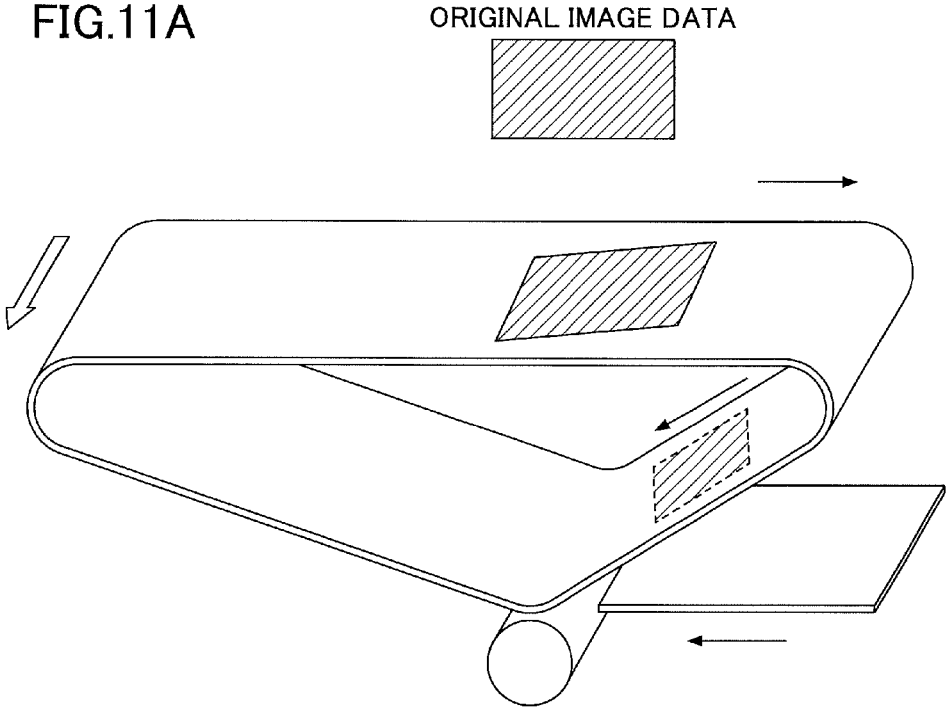
FIGS. 11A and 11B are diagrams illustrating an example in which an image is formed on the intermediate transfer belt while the intermediate transfer belt is being moved.
Figure 11B:
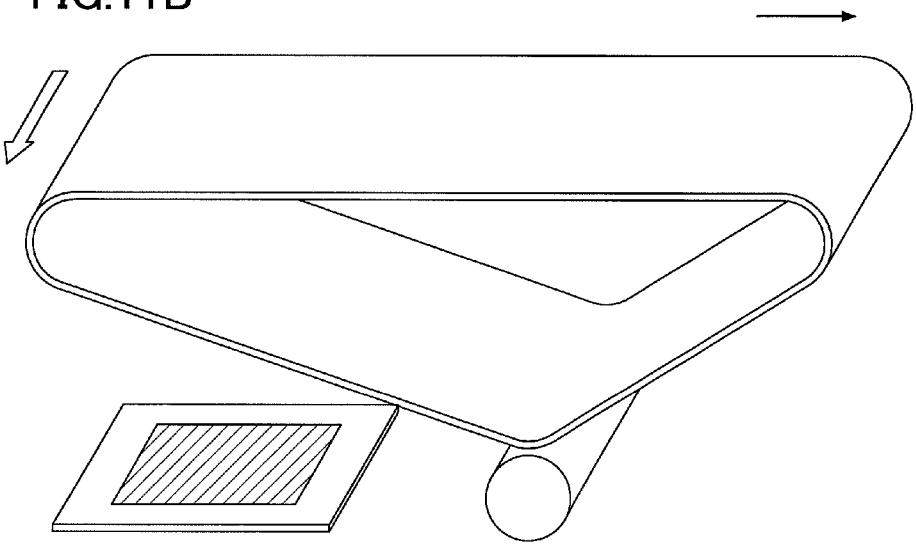

FIGS. 11A and 11B are diagrams illustrating an example in which an image is formed during the time in which the intermediate transfer belt 8 is moving. As shown in FIG. 11A, when the intermediate transfer belt 8 is moving toward right with respect to the circulating direction, since positions in the main scanning direction of an image of, for example, an original rectangular image data (it can be monochrome image data) to be printed gradually shift toward left, the image is deformed into a parallelogram shape. Here, in FIG. 11A, the parallelogram shape is exaggerated. Since the moving speed in the width direction of the intermediate transfer belt 8 is sufficiently small with respect to the moving speed in the circulating direction of the intermediate transfer belt 8, the deformation is actually not perceptible by the naked eye.

However, when the image is transferred onto the transfer paper, the intermediate transfer belt 8 moves toward left (namely, in the direction opposite to the direction at the time of the primary transfer) with respect to the circulating direction of the intermediate transfer belt 8. The transfer paper does not move in the main scanning direction, but the intermediate transfer belt 8 moves toward left at the constant speed during the transfer. Thus, during the secondary transfer, the intermediate transfer belt 8 moves an amount equal to the amount during the time of the primary transfer of the original image data, and the image transferred onto the transfer paper coincides with the original data. Therefore, as shown in FIG. 11B, the original image data in FIG. 11A is transferred onto the transfer paper without any deformation.

[Operational Procedures]

Figure 12:
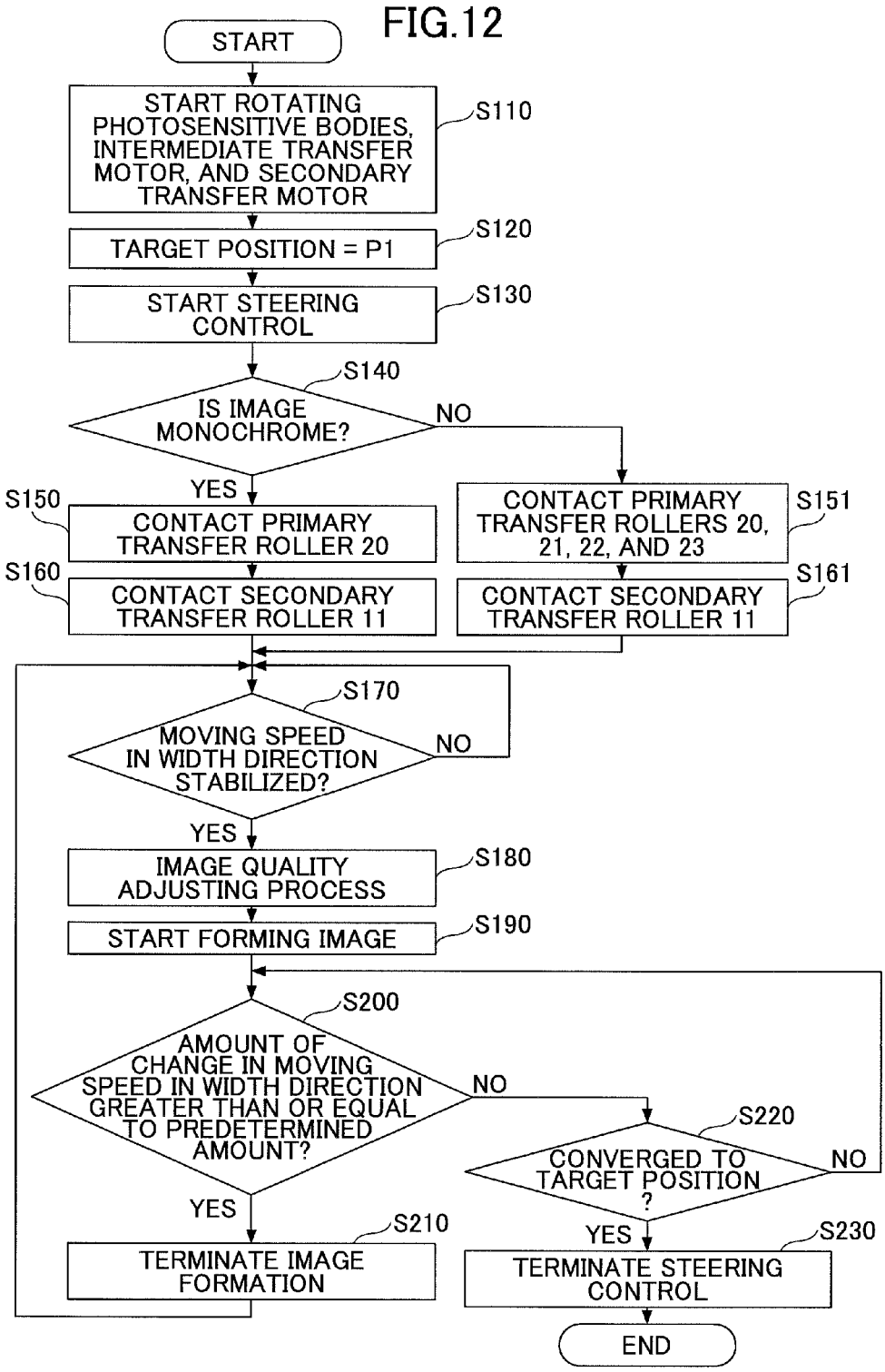
FIG. 12 is a flowchart showing an example of a procedure in which the image forming device forms an image.

FIG. 12 is a flowchart of an example of a procedure for the image forming device 100 according to the embodiment to form an image. In the procedure shown in FIG. 12, there is only one target position P1, regardless of the contact states. With such a configuration, the time can be more easily secured, during which the moving speed in the width direction of the intermediate transfer belt 8 is constant. Therefore, the downtime can be reduced.

To summarize the procedure of FIG. 12, the image forming device 100 starts monitoring the moving speed in the width direction of the intermediate transfer belt 8 at a time in which the contact state is changed. When the moving speed in the width direction of the intermediate transfer belt 8 is settled at a constant speed, the image forming device 100 performs the image quality adjusting procedure and, subsequently, starts forming an image.

The process of FIG. 12 is started when the controller 50 receives an operation on the operations panel 56, or, when the controller 50 receives a print job from a PC (not shown).

Prior to forming an image, the photosensitive bodies 1Y, 1M, 1C, and 1K; the intermediate transfer motor 10; and the secondary transfer motor 12 are stopped, and the primary transfer bias rollers 20 through 23 and the secondary transfer roller 11 are separated from the intermediate transfer belt 8.

When the image forming control unit 72 starts executing the job, the photosensitive bodies 1Y, 1M, 1C, and 1K; the intermediate transfer motor 10; and the secondary transfer motor 12 start rotating (S110).

The image forming control unit 72 requests the steering motor control unit 62 to start performing the steering control (S120). With this, the steering motor control unit 62 sets the target position to P1, and starts performing the steering control (S130).

Subsequently, the image forming control unit 72 determines whether the image data of the page to be printed is monochrome data (S140). Whether the image data is the monochrome data is determined, for example, by a content of an operation through the operations panel 56, a print condition received from the PC, or pixel values of the image data.

When the image data is the monochrome data (S140: Yes), the image forming control unit 72 causes only the primary bias transfer roller 20 for the color of black to contact the intermediate transfer belt 8 (S150). Namely, since the primary bias transfer rollers 21 through 23 for the colors of Y, M, and C are not utilized for forming the image, they are not caused to contact the intermediate transfer belt 8.

Further, the image forming control unit 72 causes the secondary transfer roller 11 to contact the intermediate transfer belt 8 (S160). The contact state has been changed by steps S150 and S160. However, the steering motor control unit 62 leaves the target position P1 unchanged. After the edge position of the intermediate transfer belt 8 is once separated from the target position P1, the edge position of the intermediate transfer belt 8 is converged with the target position P1 again by the steering control.

At step S140, when the image data is color data (S140: No), image forming control unit 72 causes the primary transfer bias rollers 20 through 23 to contact the intermediate transfer belt 8 (S151). Further, the image forming control unit 72 causes the secondary transfer roller 11 to contact the intermediate transfer belt 8 (S161). The contact state has been changed by steps S151 and S161. However, the steering motor control unit 62 leaves the target position P1 unchanged. After the edge position of the intermediate transfer belt 8 is once separated from the target position P1, the edge position of the intermediate transfer belt 8 is converged with the target position P1 again by the steering control.

Then the image forming control unit 72 waits until the speed determination unit 74 determines that the moving speed in the width direction of the intermediate transfer belt 8 is substantially settled at a constant speed (S170). Subsequently, when the moving speed in the width direction of the intermediate transfer belt 8 is sufficiently stabilized, the image forming control unit 72 causes the image quality adjusting unit 73 to perform the image quality adjusting process. With this, the image quality adjusting unit 73 performs the image quality adjustment process (S180) while the intermediate transfer belt 8 is moving at the constant speed. Here, the image quality adjustment is an image quality adjustment for correcting the color shifts in the main scanning direction. Correction of the color shifts in the circulating direction and density correction may not be performed.

After the image quality has been adjusted, the image forming control unit 72 causes the image forming engine unit 70 to start forming an image (S190). With this, the image forming device 100 may form the image prior to the edge position of the intermediate transfer belt 8 being converged with the target position.

The speed determination unit 74 is monitoring the moving speed in the width direction of the intermediate transfer belt 8. When the speed determination unit 74 determines that an amount of change in the moving speed in the width direction of the intermediate transfer belt 8 is greater than or equal to a predetermined amount (S200: Yes), the image forming control unit 72 causes the image formation termination control unit 71 to terminate the image formation (S210). The image formation termination control unit 71 terminates the image formation as follows. Here, after the image formation termination control unit 71 terminates the image formation, the image forming control unit 72 terminates forming toner images on the photosensitive bodies 1Y, 1M, 1C, and 1K, even if the image forming control unit 72 is still forming an image of a page.

When toner images have been formed on the photosensitive bodies 1Y, 1M, 1C, and 1K or on the intermediate transfer belt 8, but the toner images are not transferred onto a transfer paper, the image formation termination control unit 71 terminates transferring the toner images onto the transfer paper. In this case, the drum cleaning unit 2Y cleans the photosensitive bodies 1Y, 1M, 1C, and 1K, and the cleaning unit 34 cleans the intermediate transfer belt 8.

When toner images have been transferred onto a transfer paper, the paper ejecting destination is switched to the lower paper ejection tray 36*b*. With this, normally printed transfer papers are prevented from mixing with transfer papers, on which color shifts may have been occurred.

When the speed determination unit 74 determines that the moving speed in the width direction of the intermediate transfer belt 8 has been stabilized, the image forming control unit 72 performs the image quality adjusting process, and restarts the image formation.

When an amount of the change in the moving speed in the width direction of the intermediate transfer belt 8 is within a predetermined range (S200: No), the position determination unit 75 determines whether the edge position of the intermediate transfer belt detected by the edge sensor 15 has been converged to the target position P1 (S220). When the position determination unit 75 determines that the edge position has been converged to the target position P1, the image forming control unit 72 causes the steering motor control unit 62 to terminate the steering control (S230). After that, the image forming control unit 72 performs a similar process to that when the contact state is changed, and the image forming control unit 72 continues the image formation until the print job has completed.

In this manner, the image forming device 100 executes a routine such that when a change in the moving speed in the width direction of the intermediate transfer belt 8 occurs, the image formation is terminated, and subsequently, when the moving speed in the width direction of the intermediate transfer belt 8 is stabilized, the image quality adjusting process is performed and the image formation is restarted, until the edge position has been converged to the target position P1.

For the flowchart in FIG. 12, the correction of the edge position of the intermediate transfer belt 8 at the start time of the image formation is explained. The image forming device 100 performs this procedure when the contact state is changed (the change from the monochrome mode state to the color mode state, and the change from the color mode state to the monochrome mode state).

[Downtime]

Figure 13A:
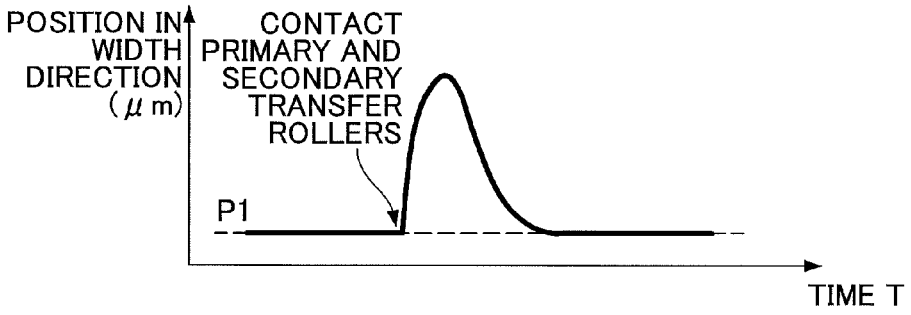
FIGS. 13A and 13B are diagrams illustrating the downtime.
Figure 13B:
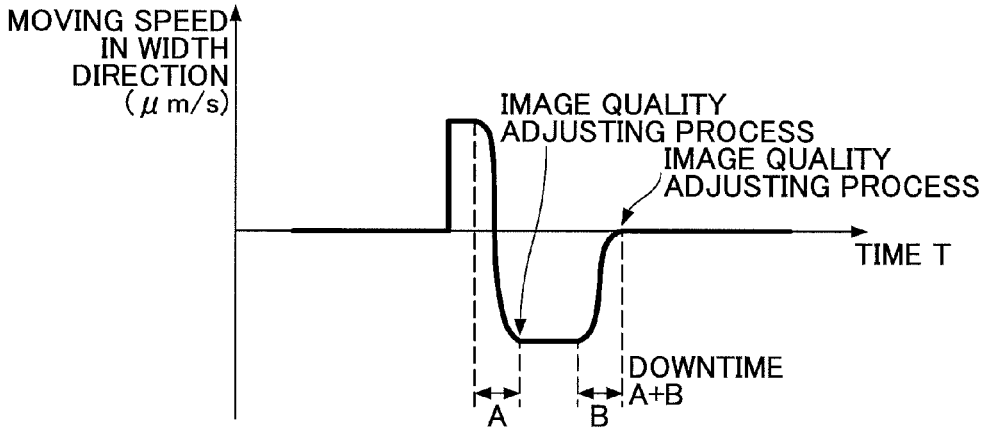

FIGS. 13A and 13B are diagrams illustrating an example of downtime according to the control of FIG. 12. FIG. 13A shows a relationship between time and the edge position. FIG. 13B shows a relationship between time and the moving speed in the width direction of the intermediate transfer belt 8. According to FIG. 13A, when the primary transfer bias rollers 20 through 23 and the secondary transfer roller 11 contact the intermediate transfer belt 8, the edge position of the intermediate transfer belt 8 is changed, and, subsequently, the edge position is converged to the target position P1 by the steering control.

As shown in FIG. 13B, since the target position P1 in the width direction of the intermediate transfer belt 8 is not changed, the moving speed in the width direction of the intermediate transfer belt 8 has been changed several times until the edge position has been converged to the target position P1. In FIG. 13B, the moving speed in the width direction of the intermediate transfer belt 8 has been significantly changed in three steps. Namely, the moving speed in the width direction of the intermediate transfer belt 8 has been changed at the time immediately after the contact state is changed, at the time prior to the moving speed in the width direction of the intermediate transfer belt 8 becoming the constant speed, and at the time prior to the edge position being converged to the target position P1.

The image forming device 100 according to the embodiment starts forming an image immediately after the moving speed in the width direction becomes the constant speed, immediately after the edge position converges to the target position P1, and after the image quality adjusting process is performed. Conventionally, the whole time spent for the edge position to converge to the target position P1 is the downtime. However, in the embodiment, the downtime is regulated to be within the time A+B indicated in FIG. 13B. Further, in reality, the time spent for the image quality adjustment is included in the downtime. However, since it is very short compared to the time spent for the edge position to converge to the target position P1, the time spent for the image quality adjustment is negligible.

Figure 14A:
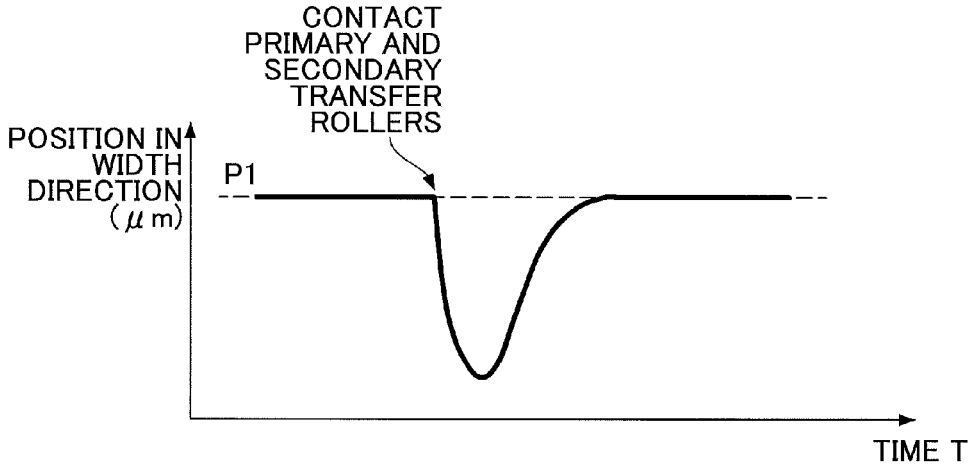
FIGS. 14A and 14B are diagrams illustrating the downtime.
Figure 14B:
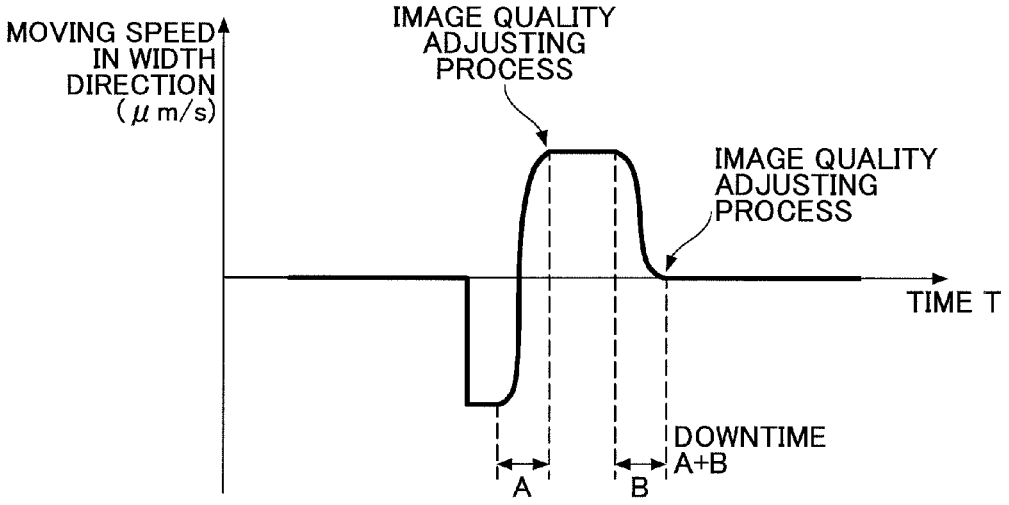

FIGS. 14A and 14B are diagrams for illustrating an example of the downtime, when the edge position of the intermediate transfer belt 8 is moved in the direction opposite to the direction of FIG. 13A. FIG. 14A indicates a relationship between time and the edge position. FIG. 14B indicates a relationship between time and the moving speed in the width direction of the intermediate transfer belt 8. According to FIG. 14A, when the primary transfer bias rollers 20 through 23 and the secondary transfer roller 11 contact the intermediate transfer belt 8, the edge position of the intermediate transfer belt 8 is moved in the direction opposite to the direction of FIG. 13A. Here, if there were plural of the target positions and if the target position were P3, as in the conventional technique, the downtime would be lengthened.

However, in the embodiment, since there is only one target position P1, the downtime may be the same regardless of whether the edge position is moved in the direction in which the coordinate value in the width direction increases from the coordinate value in the width direction of the target position P1 or the edge position is moved in the direction in which the coordinate value in the width direction decreases from the coordinate value in the width direction of the target position P1. Namely, when the moving speed in the width direction of the intermediate transfer belt significantly changes in three steps, as shown in FIG. 14B, the downtime can be regulated to be within the time A+B indicated in FIG. 14B, similar to the case of FIG. 13B.

[First Modified Example of Operational Procedure]

In FIGS. 13A and 13B, and in FIGS. 14A and 14B, there is only one target position. However, the downtime may be reduced compared to the downtime in the conventional technique, even if there are plural target positions.

Figure 15:
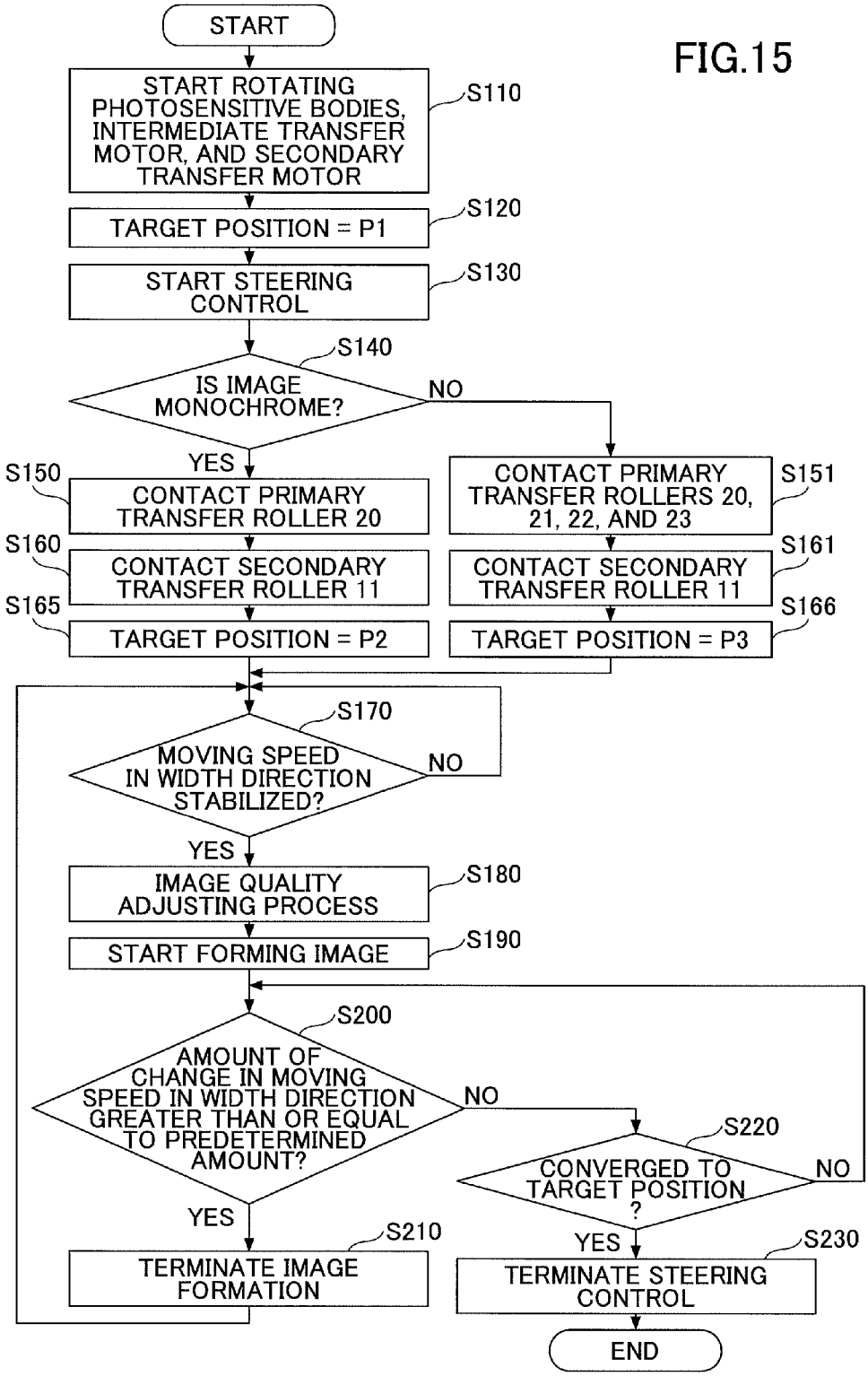
FIG. 15 is a flowchart showing an example of a procedure in which the image forming device forms an image when there are three target positions.

FIG. 15 is a flowchart illustrating an example of timing for performing the steering control in a case in which there are three target positions. For FIG. 15, the explanations for the portions of the processes, which are the same as the corresponding processes in FIG. 12, are omitted. Processes from S110 to S160 and processes from S110 to S161 are the same as that of FIG. 12.

When the image data is the monochrome data, the steering motor control unit 62 sets the target position at P2 (S165), after the process of S160. When the image data is the color data, the steering motor control unit 62 sets the target position at P3 (S166). Subsequent processes are the same as that of FIG. 12.

Namely, the image forming control unit 72 waits until the moving speed in the width direction of the intermediate transfer belt 8 is stabilized at a substantially constant speed (S170), and when the moving speed in the width direction of the intermediate transfer belt 8 is sufficiently stabilized, the image forming control unit 72 causes the image quality adjusting unit 72 to perform the image quality adjusting process. With this, the image quality adjusting unit 73 performs the image quality adjusting process (S180) while the intermediate transfer belt 8 is moving at the constant speed.

After the image quality adjustment process has been performed, the image forming control unit 72 causes the image forming engine unit 70 to start forming an image (S190). With this, the image forming device 100 can form an image, prior to the edge position reaching the target position.

The speed determination unit 74 is monitoring the moving speed in the width direction of the intermediate transfer belt 8. When the speed determination unit 74 determines that an amount of change in the moving speed in the width direction of the intermediate transfer belt 8 exceeds a predetermined value (S200: Yes), the image forming control unit 72 terminates the image formation (S210).

Further, when the amount of the change in the moving speed in the width direction of the intermediate transfer belt 8 is within a predetermined range (S200: No), the position determination unit 75 determines whether the edge position of the intermediate transfer belt 8 detected by the edge sensor 15 has been converged to the target position P1 (S220). When the position determination unit 75 determines that the edge position has been converged to the target position, the image forming control unit 72 causes the steering motor control unit 62 to terminate the steering control (S230). Here, the target position can be any of the target positions P1 through P3.

Figure 16:
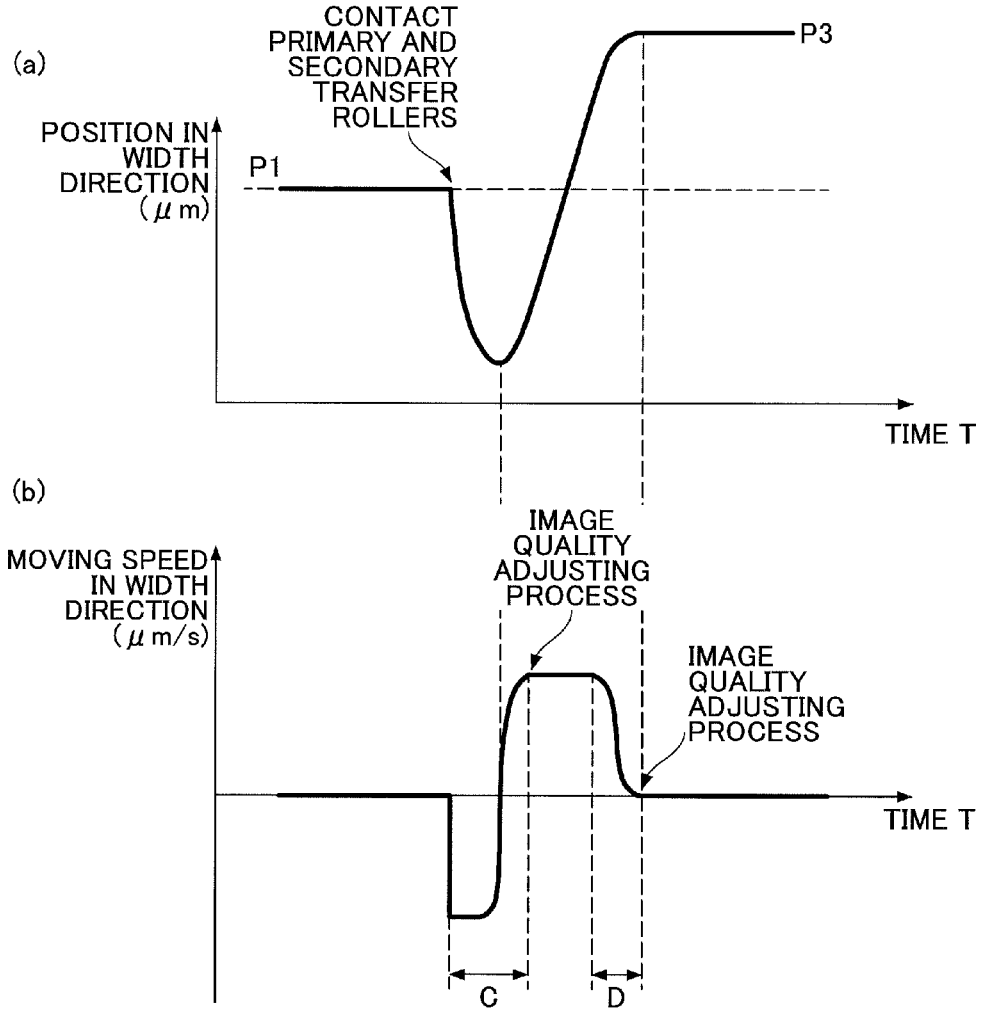
FIG. 16 is a diagram illustrating the downtime.

FIGS. 16A and 16B are diagrams illustrating an example of the downtime according to the control of FIG. 15. The graph (a) in FIG. 16 indicates a relationship between time and the edge position. The graph (b) in FIG. 16 indicates a relationship between time and the moving speed in the width direction. According to the graph (a) in FIG. 16, when the primary transfer bias rollers 20 through 23 and the secondary transfer roller 11 contact the intermediate transfer belt 8, the edge position of the intermediate transfer belt 8 moves in the direction opposite to the target position P3 for the color mode state. Subsequently, the edge position is converged with the target position P3 by the steering control. The time spent for the edge position to converge with the target position P3 is longer compared to the case in which the target position is P1.

However, as shown in the graph (b) of FIG. 16, the image forming device 100 may form an image during the time in which the moving speed in the width direction of the intermediate transfer belt 8 is stabilized, prior to the edge position being converged with the target position P3. Namely, the image forming device 100 performs the image quality adjusting process and forms an image during the time which is immediately after the moving speed in the width direction becomes constant, and during the time which is immediately after the edge position has converged with the target position P1. Therefore, even if it takes a long time for the edge position to converge with the target position P3, the downtime may be regulated to be within the time C+D in FIG. 16. The time C may be different from the time A, but the difference is not so large. Therefore, in a case in which there are plural of the target positions, the downtime may be significantly reduced compared to the downtime in the conventional technique, regardless of whether the edge position moves in a direction in which the coordinate value of the edge position in the width direction increases with respect to the coordinate value of the target position in the width direction or the edge position moves in a direction in which the coordinate value of the edge position in the width direction decreases with respect to the coordinate value of the target position in the width direction.

[Second Modified Example of Operational Procedure]

In the processes shown in FIG. 12, the image quality adjusting process is performed regardless of the contact states. However, the color shifts do not occur in the monochrome mode state. Therefore, when the next contact state to be shifted is the monochrome mode state, the image quality adjusting process may be omitted. Since the image quality adjustment is not performed for the monochrome mode state, the downtime may further be reduced compared to the downtime in FIG. 12 and FIG. 15.

Figure 17:
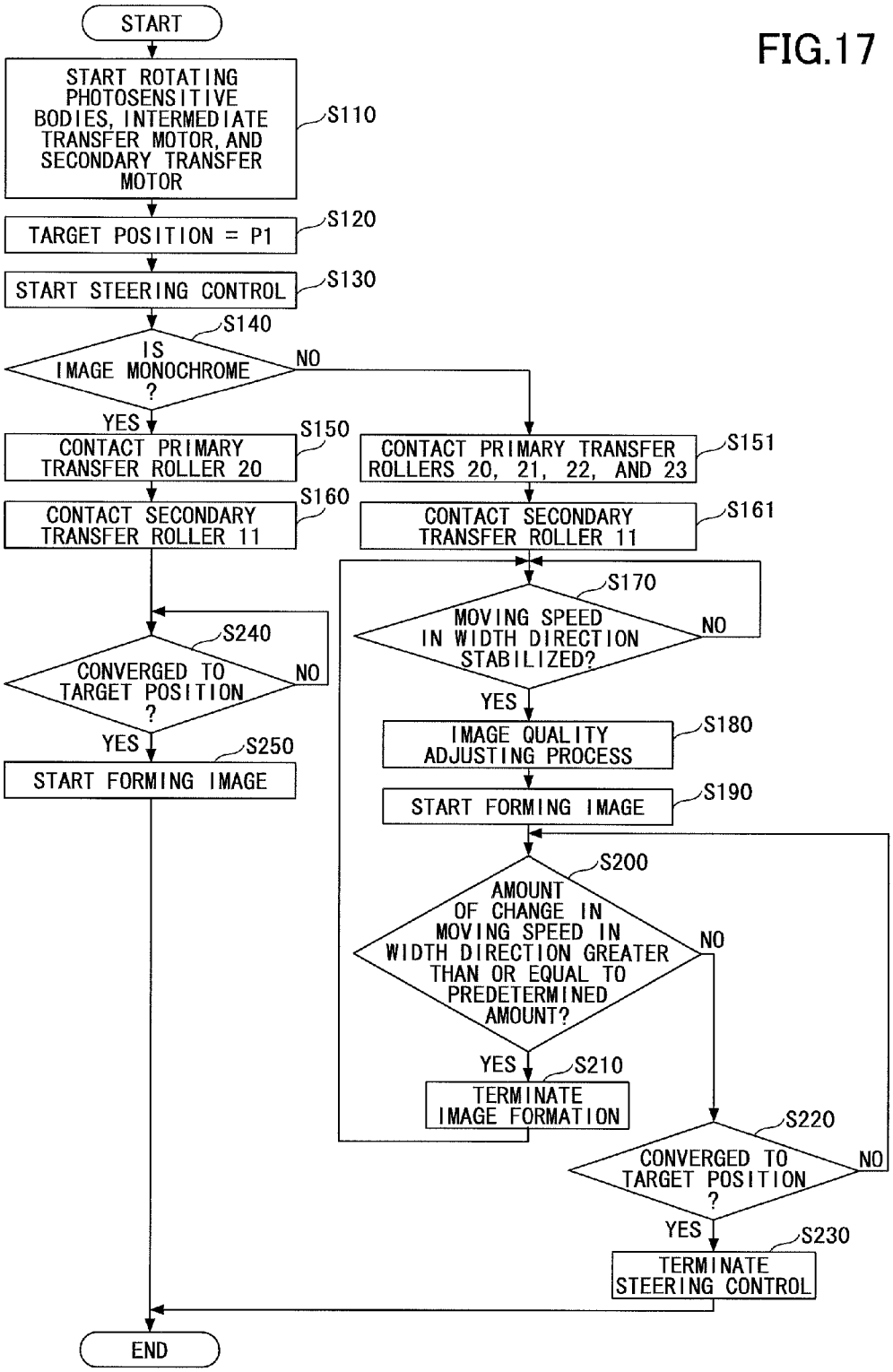
FIG. 17 is a flowchart showing an example of a procedure in which the image forming device forms an image.

FIG. 17 is a flowchart showing an example of a procedure for the image forming device 100 according to the embodiment to form an image. For the process shown in FIG. 17, there is only one target position P1. However, there may be plural of the target positions. In FIG. 17, the processes from S110 to S230 for the case in which the image data is not monochrome data are the same as the corresponding processes in FIG. 12.

However, according to the process of FIG. 17, when the image data is the monochrome data, the image forming control unit 72 does not perform, at step S160, the image quality adjusting process, after the image forming control unit 72 causes the secondary transfer roller 11 to contact the intermediate transfer belt (S160). Namely, when the contact state is the monochrome mode state, the image forming control unit 72 has started forming the image at a time in which the position determination unit 75 determines that the edge position has converged with the target position P1. Since the image is formed without performing the image quality adjusting process, when the contact state is the monochrome mode state, the downtime may further be reduced.

In this manner, according to the second modified example, when the next contact state is the monochrome mode state, the image forming device 100 forms an image without performing the image quality adjusting process. Thus the downtime can be reduced.

Here, the process of FIG. 17 is explained by using the example in which the image data is the monochrome data. Additionally, the color shifts do not occur when the image data is single color image data (one of the colors of C, M, and Y). Therefore, when the image data to be formed is the single color image data, the image forming control unit 72 may start forming the image at the time when the edge position has converged with the target position.

[Third Modified Example of Operational Procedure]

As described above, the time for performing the image quality adjusting process is sufficiently short (for example, 1 second per once). However, the downtime may further be reduced, if an image may be formed without performing the image quality adjusting process for the color image data.

When a shifted amount of the edge position of the intermediate transfer belt 8 is small, a total of the time for the image forming device 100 to wait until the moving speed in the width direction of the intermediate transfer belt 8 is stabilized, the time for the image forming device 100 to perform the image quality adjusting process, and the time for the image forming device 100 to restart forming the image may be longer than the time for the edge position to be stabilized. Namely, when the shifted amount of the edge position of the intermediate transfer belt 8 is small, the downtime is shorter if the image forming device 100 restarts the image formation soon after the edge position is stabilized, without performing the image adjusting process.

Therefore, in the third modified example, the following image forming device 100 is explained. Namely, the image forming device 100 according to the third modified example varies the timing to restart forming an image, depending on the moving speed in the width direction of the intermediate transfer belt 8, immediately after the contact state is changed.

Figure 18:
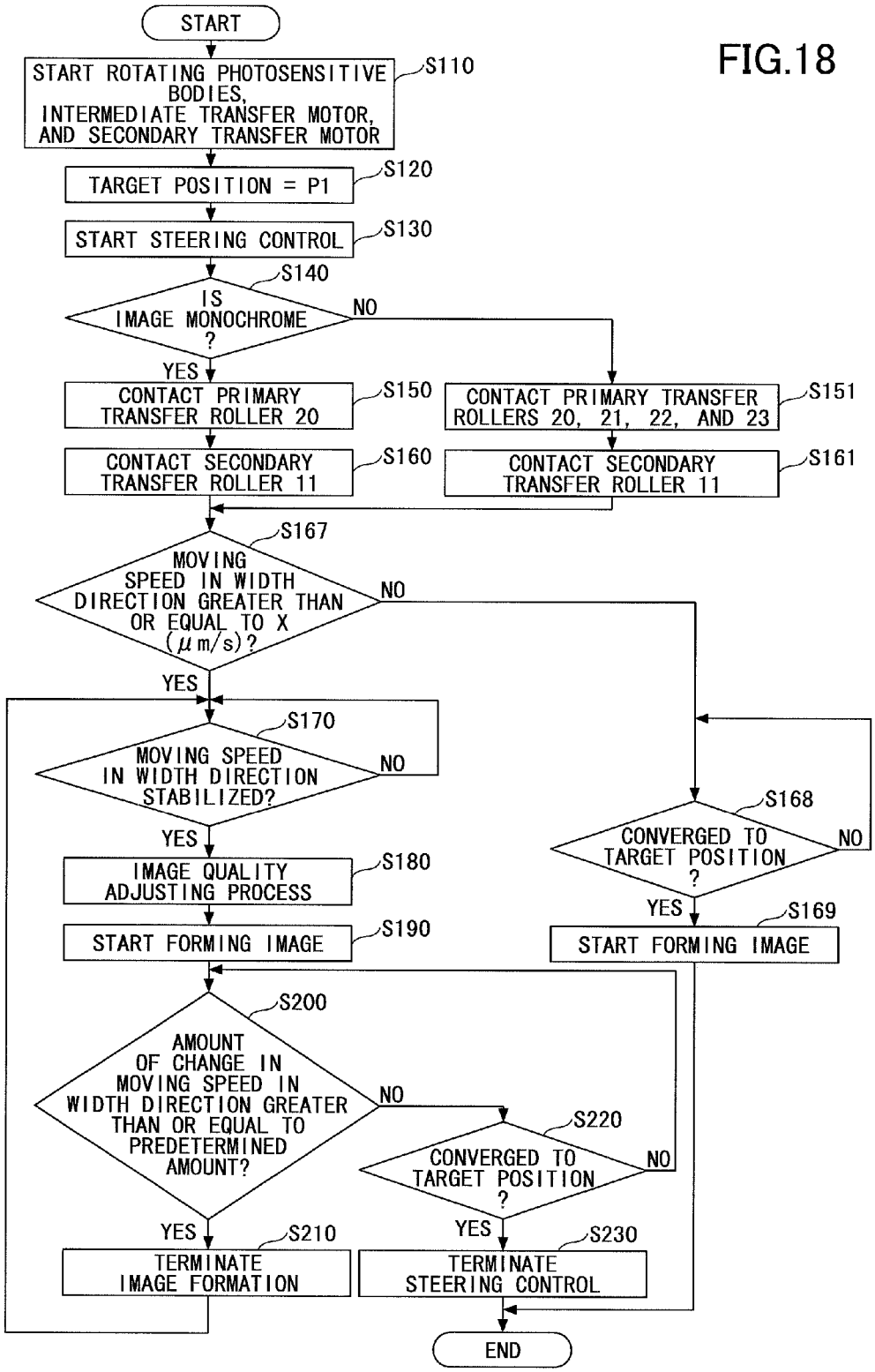
FIG. 18 is a flowchart showing an example of a procedure in which the image forming device forms an image.

FIG. 18 is a flowchart showing an example of a procedure for the image forming device 100 according to the third modified example to form an image. In the FIG. 18, there is only one target position P1 regardless of the contact states. However, there may be plural target positions.

The image forming device 100 explained in FIG. 18 varies the timing to restart forming the image as follows.

When the moving speed in the width direction of the intermediate transfer belt 8, immediately after the contact state is changed, is less than a threshold value, the image forming device 100 waits until the edge position converges with the target position. After that, the image forming device 100 restarts forming the image.

When the moving speed in the width direction of the intermediate transfer belt 8, immediately after the contact state is changed, is greater than or equal to the threshold value, the image forming device 100 terminates forming the image and waits until the moving speed in the width direction of the intermediate transfer belt 8 is stabilized. After the moving speed in the width direction of the intermediate transfer belt 8 is stabilized, the image forming device 100 restarts forming the image.

The processes from S110 to S230 in FIG. 18 are the same as the corresponding processes in FIG. 12, except for the subsequent processes after "No" at the process 5167.

According to the process of FIG. 18, after the image forming control unit 72 causes the secondary transfer roller 11 to contact the intermediate transfer belt 8 (S160), the speed determination unit 74 determines whether the moving speed in the width direction of the intermediate transfer belt 8 is greater than or equal to X (μm/s) (S167). The moving speed in the width direction of the intermediate transfer belt 8, which is compared with the threshold value X, is, for example, the maximum value of the moving speed attained within a range from 1 second to several seconds after the time at which the contact state is changed. The greater the maximum value is, the more likely that the shifted amount of the edge position is large. Further, the average value of the moving speed in the width direction of the intermediate transfer belt 8 may be adopted. Here, the moving speed is averaged over the range from 1 second to several seconds after the time at which the contact state is changed. Further, instead of comparing the moving speed in the width direction of the intermediate transfer belt 8 with the threshold value, a shifted amount of the edge position of the intermediate transfer belt 8 with respect to the target position P1 may be compared with a threshold value.

When the moving speed in the width direction of the intermediate transfer belt 8 is greater than or equal to the threshold value X (μm/s) (S167: Yes), similar to the case of FIG. 12, the image forming control unit 72 waits until the moving speed in the width direction is stabilized, regardless of whether the contact state is the monochrome mode state or the color mode state. Then, after performing the image quality adjusting process, the image forming control unit 72 starts forming the image.

Further, when the moving speed in the width direction of the intermediate transfer belt 8 is less than X (μm/s) (S167: No), similar to the case of FIG. 17, the image forming control unit 72 starts forming the image after the edge position of the intermediate transfer belt 8 is converged with the target position, regardless of whether the contact state is the monochrome state or the color state. Therefore, when the moving speed in the width direction of the intermediate transfer belt 8, immediately after the contact state is changed, is slow, the image forming control unit 72 neither waits for the moving speed to be stabilized nor performs the image quality adjusting process, even if the contact state is the color mode state. Therefore, the downtime can be reduced compared to the downtime according to the procedure of FIG. 17.

According to the process of the third modified example, since the process of waiting for the moving speed in the width direction of the intermediate transfer belt 8 to be stabilized and the image quality adjusting process are omitted even if the contact state is the color mode state, the downtime may further be reduced.

[Fourth Modified Example of Operational Procedure]

As described above, a shift of the edge position of the intermediate transfer belt 8 results in color shifts. Therefore, when the edge position of the intermediate transfer belt 8 is shifted, the image forming device 100 forms an image, at least after waiting for the edge position to converge with the target position.

However, in other words, when the shifted amount of the edge position is very small, the shift of the edge position of the intermediate transfer belt 8 during the formation of an image does not significantly lower the image quality. Therefore, depending on the shifted amount of the edge position, the image formation can be started without waiting for the edge position of the intermediate transfer belt 8 to be converged.

Figure 19:
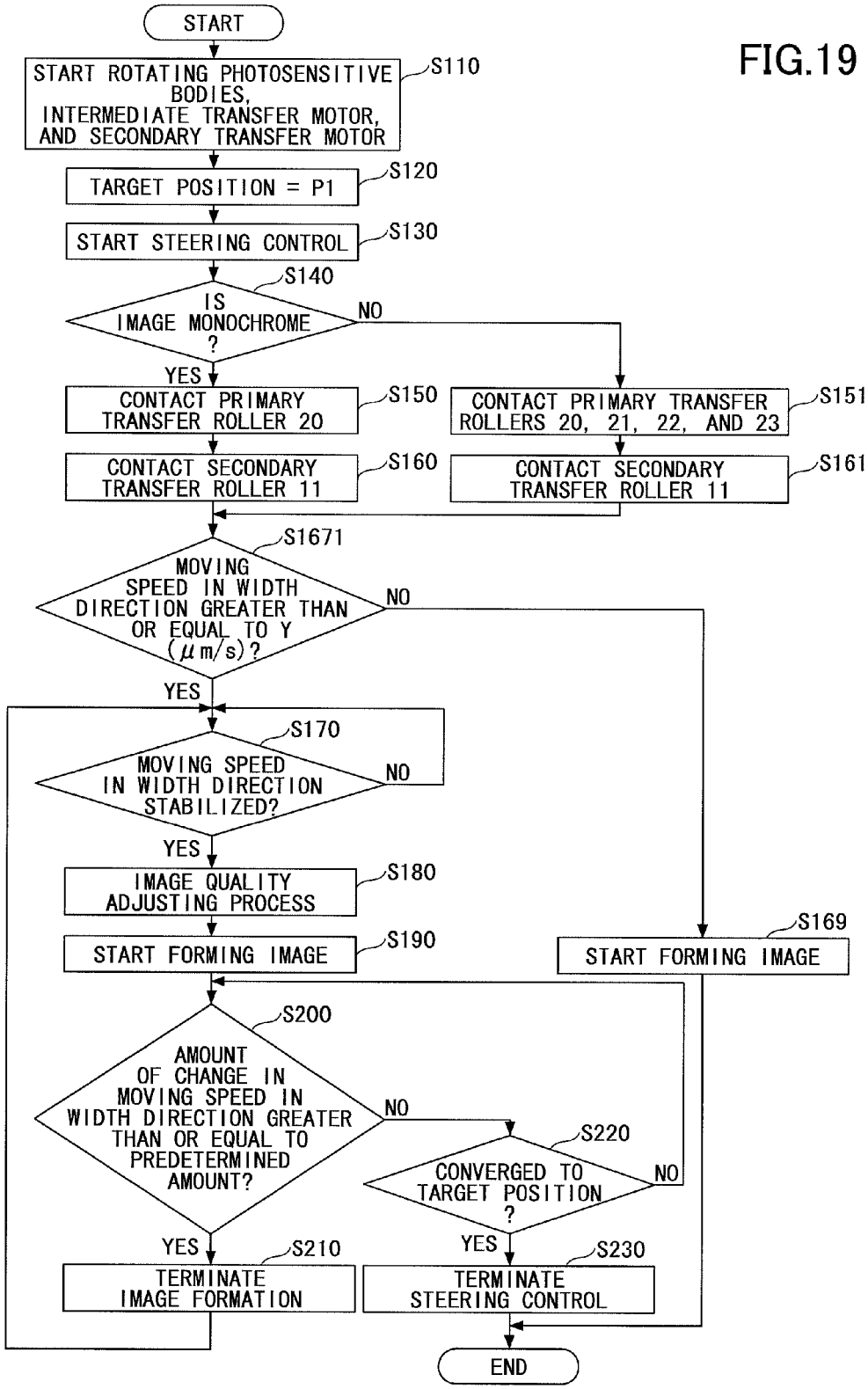
FIG. 19 is a flowchart showing an example of a procedure in which the image forming device forms an image.

FIG. 19 is a flowchart diagram of an example of a procedure for the image forming device 100 according to the fourth modified example to form an image. In FIG. 19, there is only one target position P1, regardless of the contact states. However, there may be plural of the target positions.

The image forming device 100 explained in FIG. 19 varies the timing to restart forming the image as follows.

When the shifted amount in the width direction of the intermediate transfer belt 8, immediately after the contact state is changed, is within a tolerance, the image forming device 100 forms the image without waiting for the edge position to be stabilized.

When the shifted amount in the width direction of the intermediate transfer belt 8, immediately after the contact state is changed, is not within the tolerance, the image forming device 100 terminates the formation of the image. After waiting for the moving speed in the width direction of the intermediate transfer belt 8 to be stabilized, the image forming device 100 performs the image quality adjusting process, and, subsequently, restarts forming the image.

The processes from S110 to S230 in FIG. 19 are the same as the corresponding processes in FIG. 18, except for the subsequent processes after "No" in the process of S1671.

At step S1671, the speed determination unit 74 determines as to whether the moving speed in the width direction is greater than or equal to a threshold value Y (μm/s) (S1671). The threshold value Y is less than the threshold value X. The threshold value Y is a moving speed in the width direction of the intermediate transfer belt 8, with which the intermediate transfer belt 8 may only move in a distance within which the color shifts are allowed. Further, instead of comparing the moving speed in the width direction with the threshold value, a shifted amount of the edge position of the intermediate transfer belt 8 with respect to the target position P1 may be compared with a threshold value.

When the moving speed in the width direction of the intermediate transfer belt 8 is greater than or equal to the threshold value Y (μm/s) (S1671: Yes), similar to the case of FIG. 12, the image forming control unit 72 waits for the moving speed in the width direction to be stabilized, performs the image quality adjusting process, and, subsequently, starts forming the image, regardless of whether the contact state is the monochrome state or the color state.

Further, when the moving speed in the width direction of the intermediate transfer belt 8 is less than the threshold value Y (μm/s) (S1671: No), the image forming control unit 72 forms the image (S169) without waiting for the edge position to be stabilized, regardless of whether the contact state is the monochrome stat or the color state. Since the image forming control unit 72 does not wait for the edge position to be stabilized, regardless of whether the contact state is the color mode state or the monochrome mode state, the downtime may further be reduced compared to the downtime according to the procedure of FIG. 18.

According to the process of the fourth modified example, when the shifted amount in the width direction of the intermediate transfer belt 8 is sufficiently small, the image forming device 100 does not wait for the edge position to be converged with the target position, regardless of whether the contact state is the monochrome mode state or the color mode state. Therefore, the downtime may further be reduced.

[Second Embodiment]

Figure 20:
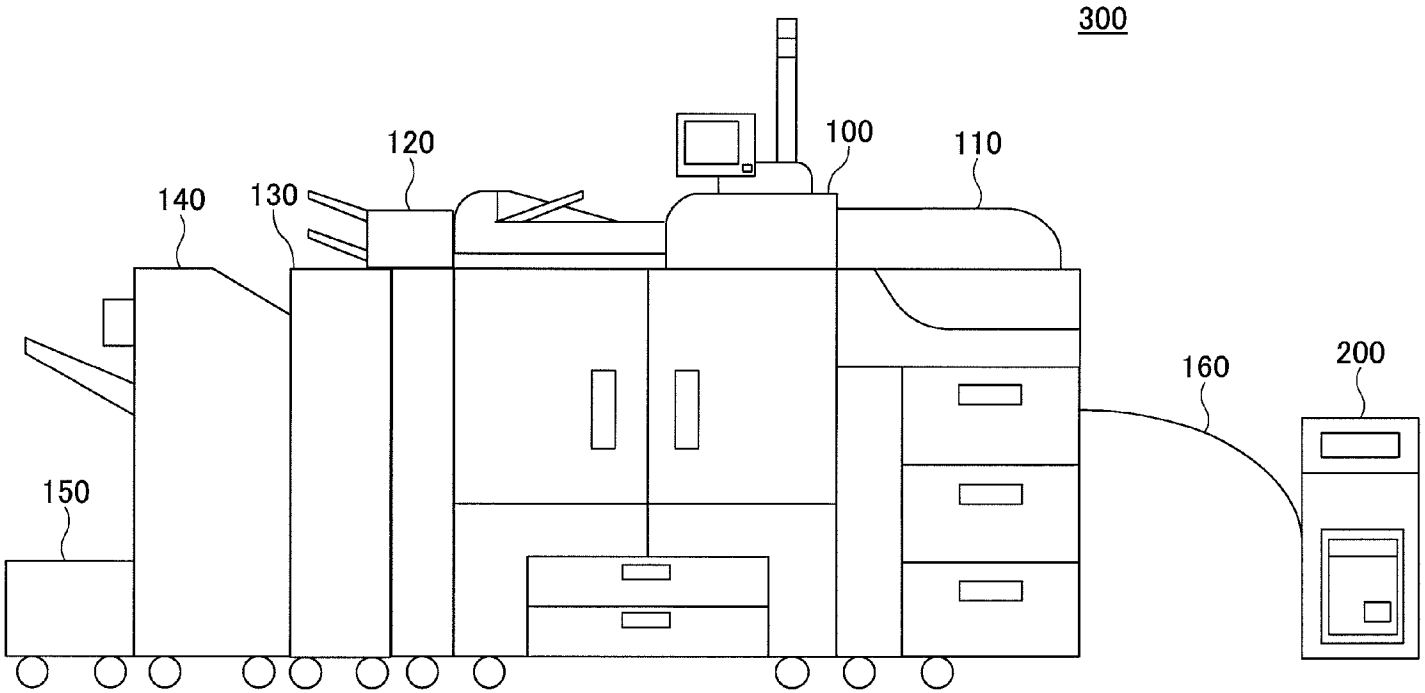
FIG. 20 is an external view of the image forming device.

In a second embodiment, the image forming device 100 is explained such that some of its functions are located outside the image forming device 100. FIG. 20 is an external view of an example of a printing system 300. The printing system 300 is a so-called "production printing machine" (printing system for small commercial printing activities).

As peripheral devices, a paper feeding unit 110, an insert feeder 120, a Z-folding unit 130, a finisher 140, and a cutting machine 150 are attached to the image forming device 100. The paper feeding unit 110 is a paper feeding device having a large capacity. The insert feeder 120 is a unit that automatically inserts a front cover, a rear cover, or an inserting paper. The Z-folding unit 130 can fold an output paper in a Z-shape. The finisher 140 has a stapling function, a stacking function, and a hole-punching function. The cutting machine 150 cuts output papers including saddle-stitched papers. In addition, various types of peripheral devices, such as a refrigeration unit or a stacker, are prepared. An operator combines the peripheral devices depending on a purpose and utilizes the combined peripheral devices along with the image forming device 100.

Further, an external server 200 is connected to the image forming device 100 according to the embodiment. The external server 200 may be referred to as "a Digital Front End" (DFE). A part of the functions of the image forming device 100 according to the first embodiment resides in the external server 200. As a production printing machine, in general, the image forming device 100 and the external server 200 are sold as a set.

Figure 21:
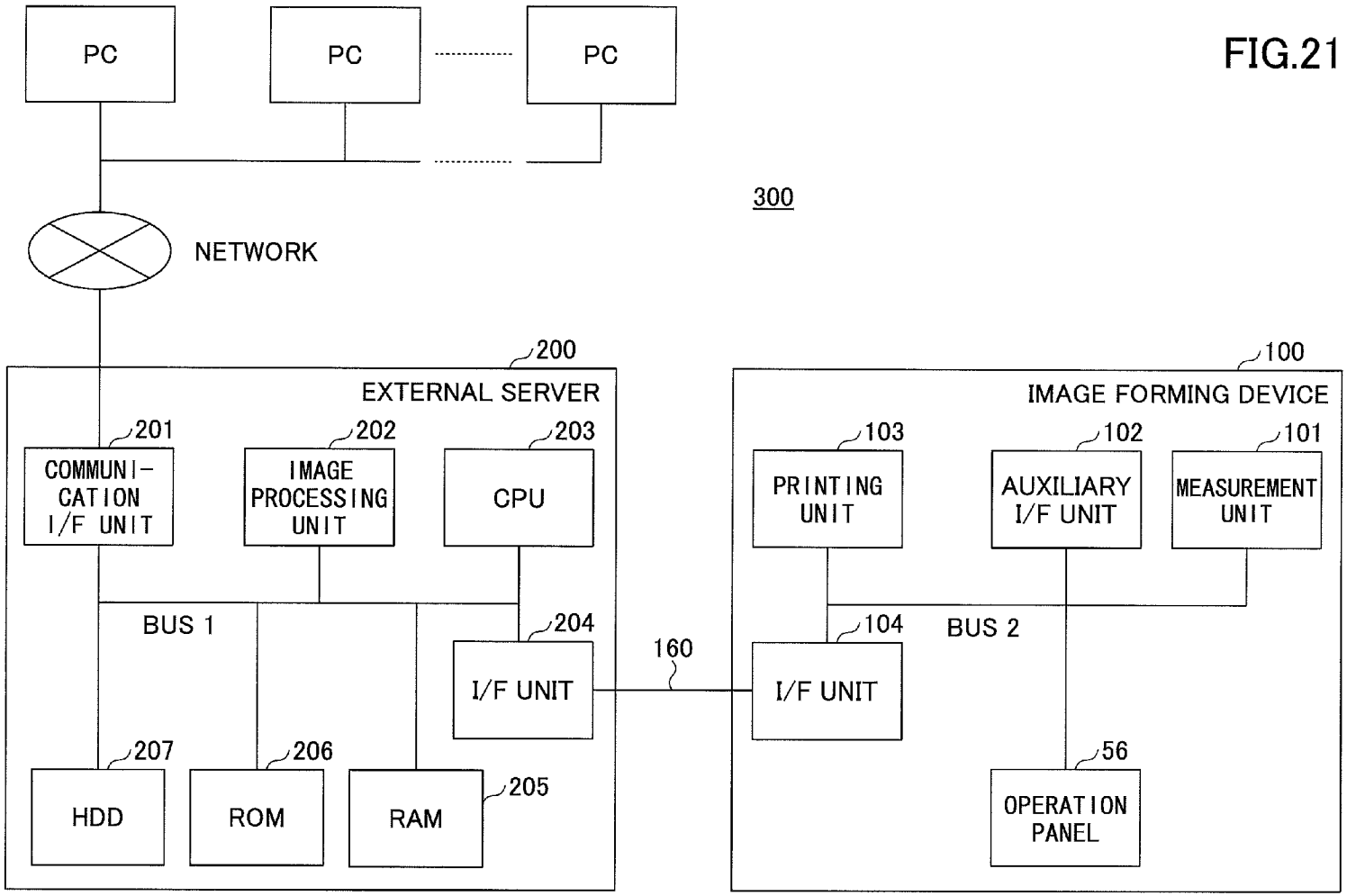
FIG. 21 is a diagram showing a configuration of a server.

FIG. 21 is a hardware configuration diagram of an example of the printing system 300. The external server 200 includes a communication I/F unit 201, an image processing unit 202, a CPU 203, an I/F unit 204, an hard-disk drive (HDD) 207, a ROM 206, and a RAM 205, which are mutually connected through a bus 1. Further, the image forming device 100 includes an I/F unit 104, a printing unit 103, an operations panel 56, an auxiliary I/F unit 102, and a measurement unit 101, which are mutually connected through a bus 2.

The external server 200 and the image forming device 100 are connected through a dedicated line 160 that connects the I/F unit 204 and the I/F unit 104. The I/F units 104 and 204 are, for example, interfaces for serial communications, such as a USB interface or an RS 232C interface. In FIGS. 20 and 21, the external server 200 and the image forming device 100 are connected through the dedicated line 160 so as to ensure a sufficient communication speed. The external server 200 and the image forming device 100 may be connected through a network, provided that the sufficient communication speed is ensured.

The image forming device 100 performs a print job under the control of the CPU 203 in the external server 200. The CPU 203 mounted on the external server 200 performs the processes explained in the first embodiment.

The measurement unit 101 included in the image forming device 100 is, for example, a thermometer for measuring an environmental temperature. The printing unit 103 and the operations panel 56 are explained in the explanation of the embodiment 1. In addition to the measurement unit 101 included in the image forming device 100, the external server 200 may include another measurement unit 101.

A control program executed by the external server 200 is stored in the HDD 207. The control program is distributed as a file in an installable form or in an executable form stored in a computer readable recording medium, such as a CD-ROM. Alternatively, the control program may be stored in a computer connected to a network, such as the Internet. In such a case, the control program may be downloaded from the computer through the network. Further, the control program may be provided or distributed through a network, such as the Internet.

The image processing unit 202 of the external server 200 has functions corresponding to the functions of the controller 50 in the first embodiment. Therefore, the image processing unit 202 includes the image forming control unit 72, the image quality adjusting unit 73, the image formation termination control unit 71 and the alignment pattern 76.

Incidentally, it is not required that all of the image forming control unit 72, the image quality adjusting unit 73, the image formation termination control unit 72 and the alignment pattern 76 are included in the external server 200. Some of them may be stored in the external server 200 and the remainder may be stored in the image forming device 100.

In this manner, by including a part or all of the functions of the controller 50 in a server, the functions included in image forming devices may be aggregated in the server. Therefore, it becomes easier to update the functions of the image forming device 100, and the cost can be reduced.

Further, the above described embodiments may be applied to an image forming device in which a secondary transfer roller 11 is not separated from an intermediate transfer belt 8, and the secondary transfer roller is kept contacting the intermediate transfer belt 8. In such a case, the steps of S160 and S161 in the flowchart of FIG. 12 are removed, and the secondary transfer roller 11 is kept contacting the intermediate transfer belt 8. Similarly, in such cases, the steps of S160 and 161 in the flowcharts of FIGS. 15, 17, 18, and 19 are removed, and the secondary transfer roller 11 is kept contacting the intermediate transfer belt 8.

The present invention is not limited to the specifically disclosed embodiments, and variations and modifications may be made without departing from the scope of the present invention.

The present application is based on Japanese Priority Applications No. 2011-061726, filed on Mar. 18, 2011, No. 2012-024490, filed on Feb. 7, 2012, and No. 2012-057228, filed on Mar. 14, 2012, the entire contents of which are hereby incorporated herein by reference.

What is claimed is:

1. An image forming device configured to form toner images on corresponding photosensitive bodies, and configured to perform primary transfers for transferring the toner images on the corresponding photosensitive bodies onto an intermediate transfer body and to perform a secondary transfer for transferring the toner images from the intermediate transfer body onto a recording medium;

the image forming device comprising:

a position correction unit configured to cause plural toner image forming units to form predetermined patterns and configured to correct forming positions of the toner images by the corresponding toner image forming units in a direction parallel to a rotation axis of the intermediate transfer body, based on information about spacing among the patterns, the spacing among the patterns being read by a pattern reading unit, a position detection unit configured to detect a position of the intermediate transfer body in the direction parallel to the rotation axis;

a position control unit configured to control movement of the intermediate transfer body;

a speed determination unit configured to determine whether a speed in the direction parallel to the rotation axis of the intermediate transfer body is stabilized, based on a time variation of the position of the intermediate transfer body detected by the position detection unit; and an image forming control unit configured to cause the position correction unit to correct the forming positions of the toner images, configured to cause the plural toner image forming units to form the corresponding toner images, configured to cause the image forming device to perform the corresponding primary transfers, and configured to cause the image forming device to perform the secondary transfer, wherein, when the position control unit controls the movement of the intermediate transfer body so that the intermediate transfer body is moved in the direction parallel to the rotation axis to a target position, the position control unit causes the intermediate transfer body to move to the target position at a constant speed at least during a part of a first time interval, the movement of the intermediate transfer body being controlled by the position control unit during the first time interval, and wherein, when the speed determination unit determines that the speed in the direction parallel to the rotation axis of the intermediate transfer body is stabilized, the image forming control unit causes the position correction unit to correct the forming positions of the toner images, and subsequently, the image forming control unit causes the plural toner image forming units to form the corresponding toner images, causes the image forming device to perform the corresponding primary transfers, or the image forming device to perform the secondary transfer, during a time interval in which the intermediate transfer body is moving in the direction parallel to the rotation axis of the intermediate transfer body at the constant speed.

2. The image forming device according to claim 1, further comprising:

plural primary transfer units configured to cause the plural photosensitive bodies to contact the intermediate transfer body; and a position determination unit configured to determine whether the position of the intermediate transfer body in the direction parallel to the rotation axis of the intermediate transfer body is stabilized, based on information about the position of the intermediate transfer body detected by the position detection unit, wherein, in a case in which one of the plural primary transfer units contacts the intermediate transfer body, so that one of the plural toner image forming units forms a first toner image, when the position determination unit determines that the position of the intermediate transfer body in the direction parallel to the rotation axis of the intermediate transfer body is stabilized, the image forming control unit causes the one of the plural toner image forming units to start forming the first toner image, causes the image forming device to start transferring the first toner image onto the intermediate transfer body, or causes the image forming device to perform the secondary transfer, without causing the speed determination unit to determine whether the speed of the intermediate transfer body in the direction parallel to the rotation axis of the intermediate transfer body is stabilized, and without causing the position correction unit to correct a forming position of the first toner image.

3. The image forming device according to claim 1, further comprising:

a position determination unit configured to determine whether the position of the intermediate transfer body in the direction parallel to the rotation axis of the intermediate transfer body is stabilized, based on information about the position of the intermediate transfer body detected by the position detection unit, wherein the image forming control unit causes the position correction unit to correct the forming positions of the toner images, and subsequently, causes the plural toner image forming units to form the corresponding toner images, causes the image forming device to perform the corresponding primary transfers; or causes the image forming device to perform the secondary transfer, only if the speed of the intermediate transfer body in the direction parallel to the rotation axis of the intermediate transfer body detected by the speed determination unit is greater than or equal to a first threshold value, and wherein, if the speed of the intermediate transfer body in the direction parallel to the rotation axis of the intermediate transfer body detected by the speed determination unit is less than the first threshold value, the image forming control unit causes the plural toner image forming units to start forming the corresponding toner images, causes the image forming device to start performing the corresponding primary transfers, or causes the image forming device to start performing the secondary transfer, when the position determination unit determines that the position of the intermediate transfer body in the direction parallel to the rotation axis of the intermediate transfer body is stabilized, without causing the speed determination unit to determine whether the speed of the intermediate transfer body in the direction parallel to the rotation axis of the intermediate transfer body is stabilized, and without causing the position correction unit to correct the forming positions of the toner images.

4. The image forming device according to claim 1, further comprising:

a position determination unit configured to determine whether the position of the intermediate transfer body in the direction parallel to the rotation axis of the intermediate transfer body is stabilized, based on information about the position of the intermediate transfer body detected by the position detection unit, wherein the image forming control unit causes the position correction unit to correct the forming positions of the toner images, and subsequently, causes the plural toner image forming units to form the corresponding toner images, causes the image forming device to perform the corresponding primary transfers, or causes the image forming device to perform the secondary transfer, only if the speed of the intermediate transfer body in the direction parallel to the rotation axis of the intermediate transfer body detected by the speed determination unit is greater than or equal to a second threshold value, and wherein, if the speed of the intermediate transfer body in the direction parallel to the rotation axis of the intermediate transfer body detected by the speed determination unit is less than the second threshold value, the image forming control unit causes the plural toner image forming units to start forming the corresponding toner images, causes the image forming device to start performing the corresponding primary transfers; or causes the image forming device to start performing the secondary transfer, when the position determination unit determines that the position of the intermediate transfer body in the direction parallel to the rotation axis of the intermediate transfer body is stabilized, without causing the speed determination unit to determine whether the speed of the intermediate transfer body in the direction parallel to the rotation axis of the intermediate transfer body is stabilized, without causing the position correction unit to correct the forming positions of the toner images, and without waiting for the position determination unit to determine whether the position of the intermediate transfer body in the direction parallel to the rotation axis of the intermediate transfer body is stabilized.

5. The image forming device according to claim 4, wherein the second threshold value corresponds to a speed which causes allowable color shifts, at most.

6. The image forming device according to claim 1, wherein the image forming device further includes a switching unit configured to switch a destination of the recording medium to which the recording medium is discharged, when the speed determination unit determines that a shifted amount of the speed of the intermediate transfer body in the direction parallel to the rotation axis of the intermediate transfer body is greater than or equal to a predetermined value, during the formation of the toner images, during the primary transfers, or during the secondary transfer.

7. The image forming device according to claim 1, wherein the image forming device further includes a toner removing unit configured to remove toner adhered to the photosensitive bodies or the intermediate transfer body, when the speed determination unit determines that a shifted amount of the speed of the intermediate transfer body in the direction parallel to the rotation axis of the intermediate transfer body is greater than or equal to a predetermined value, during the formation of the toner images, during the primary transfers, or during the secondary transfer.

8. The image forming device according to claim 1, wherein, when the speed determination unit determines that a shifted amount of the speed of the intermediate transfer body in the direction parallel to the rotation axis of the intermediate transfer body is greater than or equal to a predetermined value, during the formation of the toner images, during the primary transfers, or during the secondary transfer, and subsequently, the speed determination unit determines that the speed of the intermediate transfer body in the direction parallel to the rotation axis of the intermediate transfer body is stabilized, the image forming control unit restarts the formation of the toner images, the primary transfers, or the secondary transfer.

9. The image forming device according to claim 1, wherein, when a first state between the intermediate transfer body and the photosensitive bodies is changed from a first contact state to a first separate state, or from the first separate state to the first contact state, the first contact state being a state in which the photosensitive bodies are contacting the intermediate transfer body and the first separate state being a state in which the photosensitive bodies are separated from the intermediate transfer body, the position control unit starts controlling the movement of the intermediate transfer body, so that the intermediate transfer body is moved in the direction parallel to the rotation axis to the target position.

10. The image forming device according to claim 9, wherein the image forming device further includes a secondary transfer unit configured to cause the recording medium to contact the intermediate transfer body, wherein, when a second state between the intermediate transfer body and the secondary transfer unit is changed from a second contact state to a second separate state, or from the second separate state to the second contact state, the second contact state being a state in which the intermediate transfer body is contacting the secondary transfer unit and the second separate state being a state in which the intermediate transfer body is separated from the secondary transfer unit, the position control unit starts controlling the movement of the intermediate transfer body, so that the intermediate transfer body is moved in the direction parallel to the rotation axis to the target position.

11. The image forming device according to claim 9, wherein the position control unit switches the target position to one of plural candidate target positions, depending on whether the first state between the intermediate transfer body and the photosensitive bodies is the first contact state or the first separate state.

12. An image forming method executed by an image forming device configured to form toner images on corresponding photosensitive bodies, and configured to perform primary transfers for transferring the toner images on the corresponding photosensitive bodies onto an intermediate transfer body and to perform a secondary transfer for transferring the toner images from the intermediate transfer body onto a recording medium;

wherein the image forming device includes a position correction unit configured to cause plural toner image forming units to form predetermined patterns and configured to correct forming positions of the toner images by the corresponding toner image forming units in a direction parallel to a rotation axis of the intermediate transfer body, based on information about spacing among the patterns, the spacing among the patterns being read by a pattern reading unit, wherein the image forming method comprises:

a position detection step of detecting a position of the intermediate transfer body in the direction parallel to the rotation axis of the intermediate transfer body, the position detection step being executed by a position detection unit;

a position control step of controlling movement of the intermediate transfer body such that, when the intermediate transfer body is moved in the direction parallel to the rotation axis of the intermediate transfer body to a target position, the position control step causes the intermediate transfer body to move to the target position at a constant speed at least during a part of a first time interval, the movement of the intermediate transfer body being controlled by the position control step during the first time interval;

a speed determination step of determining whether a speed of the intermediate transfer body in the direction parallel to the rotation axis of the intermediate transfer body is stabilized, based on a time variation of information about the position of the intermediate transfer body detected by the position detection unit, the speed determination step being executed by a speed determination unit; and an image forming control step of causing the plural toner image forming units to form the corresponding toner images, causing the image forming device to perform corresponding primary transfers, or causing the image forming device to perform a secondary transfer, during a second time interval in which the intermediate transfer body is moving in the direction parallel to the rotation axis of the intermediate transfer body at the constant speed, after causing the position correction unit to correct the forming positions of the toner images, the image forming control step being executed by an image forming control unit.

13. An image forming system comprising at least an image forming device, wherein the image forming device is configured to form toner images on corresponding photosensitive bodies, and configured to perform primary transfers for transferring the toner images on the corresponding photosensitive bodies onto an intermediate transfer body and to perform a secondary transfer for transferring the toner images from the intermediate transfer body onto a recording medium, wherein the image forming device includes a position detection unit configured to detect a position of the intermediate transfer body in a direction parallel to a rotation axis of the intermediate transfer body; and a position control unit configured to control movement of the intermediate transfer body, wherein, when the position control unit controls the movement of the intermediate transfer body so that the intermediate transfer body is moved in the direction parallel to the rotation axis to a target position, the position control unit causes the intermediate transfer body to move to the target position at a constant speed, at least during a part of a first time interval, the movement of the intermediate transfer body being controlled by the position control unit during the first time interval;

wherein the image forming system includes a position correction unit configured to cause plural toner image forming units to form predetermined patterns and configured to correct forming positions of the toner images by the corresponding toner image forming units in a direction parallel to the rotation axis of the intermediate transfer body, based on information about spacing among the patterns, the spacing among the patterns being read by a pattern reading unit;

a speed determination unit configured to determine whether a speed of the intermediate transfer body in the direction parallel to the rotation axis of the intermediate transfer body is stabilized, based on a time variation of the position of the intermediate transfer body detected by the position detection unit; and an image forming control unit configured to cause the plural toner image forming units to form the corresponding toner images, to cause the image forming device to perform corresponding primary transfers, or to cause the image forming device to perform a secondary transfer, when the speed determination unit determines that the speed of the intermediate transfer body in the direction parallel to the rotation axis of the intermediate transfer body is stabilized, after causing the position correction unit to correct the forming positions of the toner images.

* * * * *